US006373788B1

(12) United States Patent
Moteki et al.

(10) Patent No.: US 6,373,788 B1
(45) Date of Patent: Apr. 16, 2002

(54) ELECTRONICALLY CONTROLLED MECHANICAL TIMEPIECE

(75) Inventors: Masatoshi Moteki, Shiojiri; Osamu Takahashi, Matsumoto, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/600,501

(22) PCT Filed: Nov. 17, 1999

(86) PCT No.: PCT/JP99/06427

§ 371 Date: Sep. 21, 2000

§ 102(e) Date: Sep. 21, 2000

(87) PCT Pub. No.: WO00/29911

PCT Pub. Date: May 25, 2000

(30) Foreign Application Priority Data

Nov. 17, 1998 (JP) ..... 10-326821

(51) Int. Cl.[7] ..... G04B 1/00
(52) U.S. Cl. ..... 368/203; 368/204
(58) Field of Search ..... 368/203–204, 368/64, 66, 76, 140

(56) References Cited

U.S. PATENT DOCUMENTS 5,835,456 A * 11/1998 Fairne ..... 368/204
6,016,289 A * 1/2000 Kaelin ..... 368/203
6,097,675 A * 8/2000 Takahashi et al. ..... 368/203
6,252,828 B1 * 6/2001 Shinikawa et al. ..... 368/203

FOREIGN PATENT DOCUMENTS

| | | |
|---|---|---|
| EP | 0 239 820 | 10/1987 |
| JP | 48-21060 | 6/1973 |
| JP | 57-132267 | 2/1981 |
| JP | 62-255889 | 11/1987 |
| JP | 1-223388 | 9/1989 |
| JP | 3-45158 | 2/1991 |
| JP | 4-1479 | 1/1992 |
| JP | 8-5758 | 1/1996 |

* cited by examiner

*Primary Examiner*—Bernard Roskoski
(74) *Attorney, Agent, or Firm*—Mark Watson; Michael T. Gabrik

(57) ABSTRACT

A gap h between a rotor inertia disk 12*c* and stators 123 and 133 is set so that the load torque between the components due to air viscosity resistance is equal to or less than 1/10 of the maximum output torque at a rotor. Since the load torque is thereby sufficiently reduced, it is possible to limit energy loss of a mainspring, and to extend the period of operation of a timepiece.

11 Claims, 12 Drawing Sheets

ELECTRONICALLY CONTROLLED MECHANICAL TIMEPIECE

BACKGROUND OF THE INVENTION

1. Field of the Invention

The present invention relates to an electronically controlled mechanical timepiece which is operated by a mechanical energy storing means, such as a mainspring, serving as a drive source, converts a part of mechanical energy into electrical energy by a power generator, and operates a rotation control means by the electrical power so as to control the rotational cycle. More particularly, the present invention relates to an improvement in the peripheral structure of a power generator for converting mechanical energy into electrical energy.

2. Description of the Related Art

Japanese Unexamined Patent Application Publication No. 8-5758 discloses an electronically controlled mechanical timepiece in which mechanical energy generated when a mainspring unwinds is converted into electrical energy by a power generator, the value of current passing through a coil of the power generator, or the like, is controlled by operating a rotation control means by the electrical energy, and a pointer fixed to a gear train is thereby precisely driven so as to indicate the exact time.

FIGS. 17 and 18 are a plan view and a cross-sectional view, respectively, of a timepiece disclosed in the publication.

Referring to the figures, rotational power from a barrel drum 1 with a mainspring built therein is transmitted to a power generator 20 at an increased speed via a gear train consisting of a center wheel and pinion 7, a third wheel and pinion 8, a fourth wheel and pinion 9, a fifth wheel and pinion 10, and a sixth wheel and pinion 11 supported by a main plate 2, a train wheel bridge 3, and a second bridge 113.

The power generator 20 has a structure similar to that of a step motor for driving a conventional battery-driven electronic timepiece, and comprises a rotor 12, a stator 150, and a coil block 160.

In the rotor 12, a rotor magnet 12*b* and a rotor inertia disk 12*c* are formed integrally with the shaft of a rotor pinion 12*a* that rotates in connection with the sixth wheel and pinion 11.

The stator 150 is formed by winding a stator coil 150*b* with 40,000 turns around a stator member 150*a*.

The coil block 160 is formed by winding a coil 160*b* with 110,000 turns around a magnetic core 160*a*. The stator coil 150*b* and the coil 160*b* are connected in series so as to output the sum of voltages generated thereby.

In the power generator 20, electrical power obtained by rotation of the rotor 12 is supplied to an electronic circuit having a quartz oscillator via a capacitor (not shown), and the electronic circuit transmits signals for controlling the rotation of the rotor to the coil in accordance with the detected rotation of the rotor and the reference frequency. As a result, the gear train constantly rotates at a constant rotation speed in accordance with the braking force.

Since pointers are driven by the mainspring serving as a power source in such an electronically controlled mechanical timepiece, a motor for driving the pointers is unnecessary and the number of components is small, which lowers the costs. In addition, only a small amount of electrical energy needs to be generated so as to operate the electronic circuit, and the timepiece can be operated by a small amount of input energy.

In the electronically controlled mechanical timepiece described in the above publication, the rotor 12 must be rotated at a constant speed by the force which is generated by the unwinding of the mainspring, and the rotor inertia disk 12*c* is provided to stabilize the rotation of the rotor 12.

However, since the main plate 2 and the stator 150 are placed around the rotor inertia disk 12*c* so as to closely face the rotor inertia disk 12*c* in the axial direction, when the gap between the rotor inertia disk 12*c* and the main plate 2 or the stator 150 is too small, air viscosity resistance produced therebetween has an adverse effect on the rotation of the rotor 12. That is, when the gap between the components is too small, air viscosity resistance increases and a load torque needed to rotate the rotor 12 also increases. As a result, the period of operation of the timepiece is shortened in accordance with the increase.

As the power generator used in the electronically controlled mechanical timepiece, a power generator having a structure similar to that of a brushless motor is sometimes used, besides the power generator including the inertia disk 12*c*. In such a power generator, a pair of disk-like stator members are mounted along the axial direction of the rotor, and are provided with a plurality of magnets arranged in the circumferential direction so that the poles thereof are alternately different. A coil formed on a substrate is interposed between these stator members (between the magnets). Accordingly, since the rotor itself including the disk-like stator members also functions as an inertia disk, the above-described inertia disk 12*c* is unnecessary.

In such a power generator, however, when the gap between the stators, and the main plate or the coil is too small, the above problems are also caused by air viscosity resistance between the components.

OBJECTS OF THE INVENTION

An object of the present invention is to provide an electronically controlled mechanical timepiece in which the period of operation thereof can be extended by reducing the influence of air viscosity resistance.

SUMMARY OF THE INVENTION

According to the present invention, there is provided an electronically controlled mechanical timepiece wherein a mechanical energy transmitting means is driven by a mechanical energy storing means serving as an energy source, electrical power is generated by a power generator rotated by the mechanical energy transmitting means, the rotation cycle of the power generator is controlled by an electronic circuit driven by the electrical power so as to brake the mechanical energy transmitting means and to thereby adjust the speed, characterized in that the power generator has a rotor rotating in connection with the mechanical energy transmitting means, and a constant K is set to be 1/10 or less when a gap h between a largest-diameter member in the rotor and a counter component fixed to most closely face the rotor in the axial direction is given by the following formula:

$$h = \frac{\pi^2 f \mu}{K T_{rz\max}} (r_2^4 - r_1^4)$$

where $\pi$ represents the ratio of the circumference of a circle to its diameter, $\mu$ represents the air viscosity, f represents the rotational frequency of the rotor, $T_{rzmax}$ represents the maximum output torque of the mechanical energy storing means to be transmitted to the rotor, $r_1$ represents a distance from the center of rotation of the rotor to the inner periphery of a portion where the largest-diameter member in the rotor and the counter component overlap in a plane, and $r_2$ represents a distance from the center of rotation of the rotor to the outer periphery of the portion where the largest-diameter member in the rotor and the counter component overlap in a plane.

Herein, "counter component" and "largest-diameter member" refer to a component and a member between which viscosity resistance increases as the gap h therebetween decreases, thereby increasing the load torque at the rotor.

Therefore, "counter component" does not include a component, for example, a bridge-shaped or cantilevered supporting member claimed as in the following, which overlaps with the largest-diameter in the rotor in a plane and in which air viscosity resistance between the component and the largest-diameter member does not cause any problem even when the gap h decreases.

Regarding "largest-diameter member", for example, in a case in which a projection for enhancing inertia is formed at a position on the largest-diameter member, such as a rotor inertia disk, offset outward from the midpoint of the radius of the largest-diameter member so as to protrude toward the counter component, when the area of a portion of the projection, which overlaps with the counter component in a plane, is less than ⅕ of the area formed by the largest diameter, air viscosity resistance between the opposing surfaces of the projection and the counter component does not cause a problem. Such a gap between the opposing surfaces does not correspond to the gap h of this invention. The gap h of this invention refers to a gap between a surface of a component other than the projection and the counter component. The projection does not correspond to the largest-diameter member of this invention.

Even if the above projection is provided offset from the midpoint of the radius of the largest-diameter member, such as a rotor inertia disk, toward the center, when the area of a portion of the projection overlapping with the counter component in a plane is less than ⅖ of the area formed by the largest diameter, air viscosity resistance between the opposing surfaces of the projection and the counter component does not cause a problem. Such a gap between the opposing surfaces also does not correspond to the gap h of this invention. The gap h of this invention refers to a gap between the surface of a component other than the projection and the counter component. The projection also does not correspond to the largest-diameter member of this invention.

In the present invention described above, while the power generator is structured to include the rotor, the gap h between the largest-diameter member in the rotor, where air viscosity resistance is prone to cause a problem, and the counter component, is set so that the load torque due to air viscosity resistance between the components is equal to or less than 1/10 (10%) of the maximum output torque $T_{rzmax}$ to be transmitted from the mechanical energy storing means to the rotor.

For example, a graph shown in FIG. 14 shows the relationship between the load torques $T_{2\#}$ at the center wheel and pinion 7 (see FIGS. 1 and 2 for the reference numeral) which the present inventor obtained by conducting an experiment described in a first example, which will be described later, and the gap h, and the relationship between values obtained by converting the rotor load torques $T_{rz}$ due to air viscosity, which the present inventor calculated according to the theory described in a first embodiment, which will be described later, into load torques $T_{2\#}$ at the center wheel and pinion 7.

Referring to this graph, since the values obtained by subtracting calculated values from actually measured values are substantially constant regardless of the gap h, it can be determined that these values are load resistances other than air viscosity resistance acting between a rotor 12 and the counter component (for example, stators 123 and 133), such as mechanical friction in the gear train and viscosity resistance of oil at a tenon.

In contrast, a graph shown in FIG. 16 shows the relationship among the gap h, the period of operation, and the thickness of the movement, as described in a second example which will be described later.

It is known from the graphs shown in FIGS. 14 and 16 that the load due to air viscosity rapidly increases and the period of operation is rapidly shortened when the gap h is less than 0.1 mm. The period of operation is determined by the relationship between the ability of a mainspring 1*a* and a load torque necessary for driving the timepiece. The load torque $T_{rz}$ at the rotor 12 due to air viscosity when the gap h is 0.1 mm is $84.34\times10^{-6}$ N·m (a value obtained by converting 0.86 gcm into the International System of Units) which is converted into the load torque at the center wheel and pinion 7, as shown in the graph in FIG. 14. This load torque corresponds to nearly 1/10 of the maximum output torque $T_{rzmax}$ to be transmitted from the mainspring 1*a* serving as the mechanical energy storing means to the rotor 12.

From the above, when the gap h is set so that the coefficient K is 1/10 or less, the load torque $T_{rz}$ at the rotor 12 due to air viscosity resistance is limited, and energy loss in the mechanical energy storing means is also limited, which extends the period of operation of the timepiece.

An electronically controlled mechanical timepiece claimed as in Claim 2 is characterized in that the coefficient K is set to be 1/20 to 1/60.

An electronically controlled mechanical timepiece claimed as in Claim 3 is characterized in that the coefficient K is set to be 1/20 to 1/40.

FIG. 16 shows that the period of operation is not extended while the thickness of the movement increases when the gap h is 0.6 mm or more. When the gap h is 0.6 mm, the converted load torque $T_{2.}$ at the center wheel and pinion 7 due to air viscosity is 13.73×10−6 N·m (a value obtained by converting 0.14 gcm into the International System of Units), as shown in FIG. 14, and it corresponds to nearly 1/60 of the maximum output torque $T_{rzmax}$ to be transmitted from the mainspring 1*a* to the rotor 12.

In consideration of the period of operation and the thickness of the movement required for the timepiece, a more preferable gap h is approximately 0.2 mm to 0.4 mm. The load torque $T_{2\#}$ due to air viscosity is 42.17×10−6 N·m (a value obtained by converting 0.43 gcm into the International System of Units) when the gap h is 0.2 mm, and is 21.57×10−6 N·m (a value obtained by converting 0.22 gcm into the International System of Units) when the gap h is 0.4 mm, which respectively correspond to nearly 1/20 and 1/40 of the maximum output torque $T_{rzmax}$ to be transmitted from the mainspring 1*a* to the rotor 12.

An electronically controlled mechanical timepiece is characterized in that the counter component is a supporting member for supporting at least one end portion of the rotor in the axial direction, and in that the supporting member is disposed at a greater distance in the axial direction from the rotor than a bearing held by the supporting member so as to receive the one end in the axial direction.

As the supporting member, for example, a train wheel bridge for receiving a gear train serving as the mechanical energy transmitting means, and a main plate may be adopted.

In such a configuration, the supporting member, which is disposed at a greater distance (at a greater distance in the radial direction) from the center of rotation of the rotor than the bearing close to the center of rotation, is also at a greater distance from the rotor in the axial direction. This makes it possible to reliably ensure the gap h between the supporting member and the largest-diameter member in the rotor while appropriately maintaining the engaged state between the bearing and the rotor in the axial direction without any change.

An electronically controlled mechanical timepiece is also characterized in that the counter component is a supporting member for supporting at least one end portion of the rotor in the axial direction, in that the supporting member includes a holding section for holding a bearing for receiving the one end in the axial direction, and in that a portion on the periphery of the holding section is disposed at a greater distance from the rotor in the axial direction than the holding section. As the supporting member, a gear train and a main plate may also be adopted.

In such a configuration, since only the portion of the supporting member closely facing the largest-diameter member in the rotor is at a great distance from the rotor, and the structure and the like of the bearing itself are not changed, the same operations and advantages as those described above are provided. In addition, since the holding section formed in the supporting member so as to hold the bearing is not at a great distance from the rotor and is made to be sufficiently thick, the bearing is thereby held reliably. In this case, since the holding section is placed offset toward the center of rotation of the rotor, that is, at a position where the peripheral velocity of the rotor is low and air viscosity resistance is not serious, it does not act to shorten the period of operation of the timepiece.

An electronically controlled mechanical timepiece is further characterized in that one end portion of the rotor in the axial direction is supported by a supporting member which is formed separately from a component for supporting the mechanical energy transmitting means and which is shaped like a bridge or is cantilevered.

In such a configuration, since the supporting member for supporting the rotor is formed separately from the component for supporting the mechanical energy transmitting means, the rotor supporting member can be bridge-shaped or be cantilevered, not in the form of planar surfaces, but in ae form nearly like a rod. Therefore, it is possible to reliably place the counter component, closely facing the rotor in the axial direction, at a distance larger than the gap h while reliably supporting the rotor.

An electronically controlled mechanical timepiece is also characterized in that the mechanical energy transmitting means is a gear train including a plurality of wheels, and in that a gap h' in the axial direction between the rotor and the wheels serving as the mechanical energy transmitting means to be meshed with the rotor is smaller than the gap h.

In such a case, the thickness of the timepiece is reduced by setting the gap h' to be smaller than the gap h, which further reduces the thickness of the timepiece. In this case, since the portions of the wheels and the rotor (a rotor inertia disk or a rotor member which will be described later) overlapping with each other move in the same direction with the rotation in the engaged state, the relative speed at the overlapping portions is not very high. There is no problem in practice as long as the gap h is set so that the wheels meshed with the rotor and the rotor do not contact even when they undergo runout due to air viscosity resistance produced between the components. When $h' \geqq 1/2\ h$, the influence of air viscosity resistance can be reduced sufficiently.

An electronically controlled mechanical timepiece is characterized in that a proximity component is interposed between the largest-diameter member in the rotor and the counter component, and in that the proximity component has a through opening extending in the axial direction at a position corresponding to the largest-diameter member of the rotor.

In such a configuration, since the opening is formed at the position of the proximity component facing the largest-diameter member in the rotor, it is possible to place the proximity component between the largest-diameter member in the rotor and the counter component without any influence on the load torque of the rotor while reliably ensuring the gap h between the largest-diameter member and the counter component, and to thereby enhance the efficiency of layout in a component layout space inside the timepiece.

An electronically controlled mechanical timepiece is characterized in that the pressure inside a movement including the mechanical energy storing means, the mechanical energy transmitting means, and the power generator, is reduced.

Herein, "the pressure is reduced" includes a vacuum state.

In this invention, since the air density inside the movement is low, air viscosity resistance described above does not cause a problem, and the period of operation of the timepiece can be extended substantially.

On the other hand, an electronically controlled mechanical timepiece is also characterized in that the rotor in the power generator has an inertia wheel protruding in the radial direction, and in that the inertia wheel serves as the largest-diameter member in the rotor.

An electronically controlled mechanical timepiece is characterized in that the rotor in the power generator has a rotor member protruding in the radial direction and having a plurality of rotor magnets arranged in the circumferential direction, and in that the rotor member serves as the largest-diameter member in the rotor.

As such power generator used in the electronically controlled mechanical timepiece of this invention, two types of power generators, a type including a rotor with an inertia wheel and a type including a rotor having a rotor member, may be adopted.

BRIEF DESCRIPTION OF THE DRAWINGS

In the drawings, wherein like reference symbols refer to like parts.

DESCRIPTION OF THE PREFERRED EMBODIMENTS

Embodiments of the present invention will be described below with reference to the drawings.

[First Embodiment]

Figure 1:
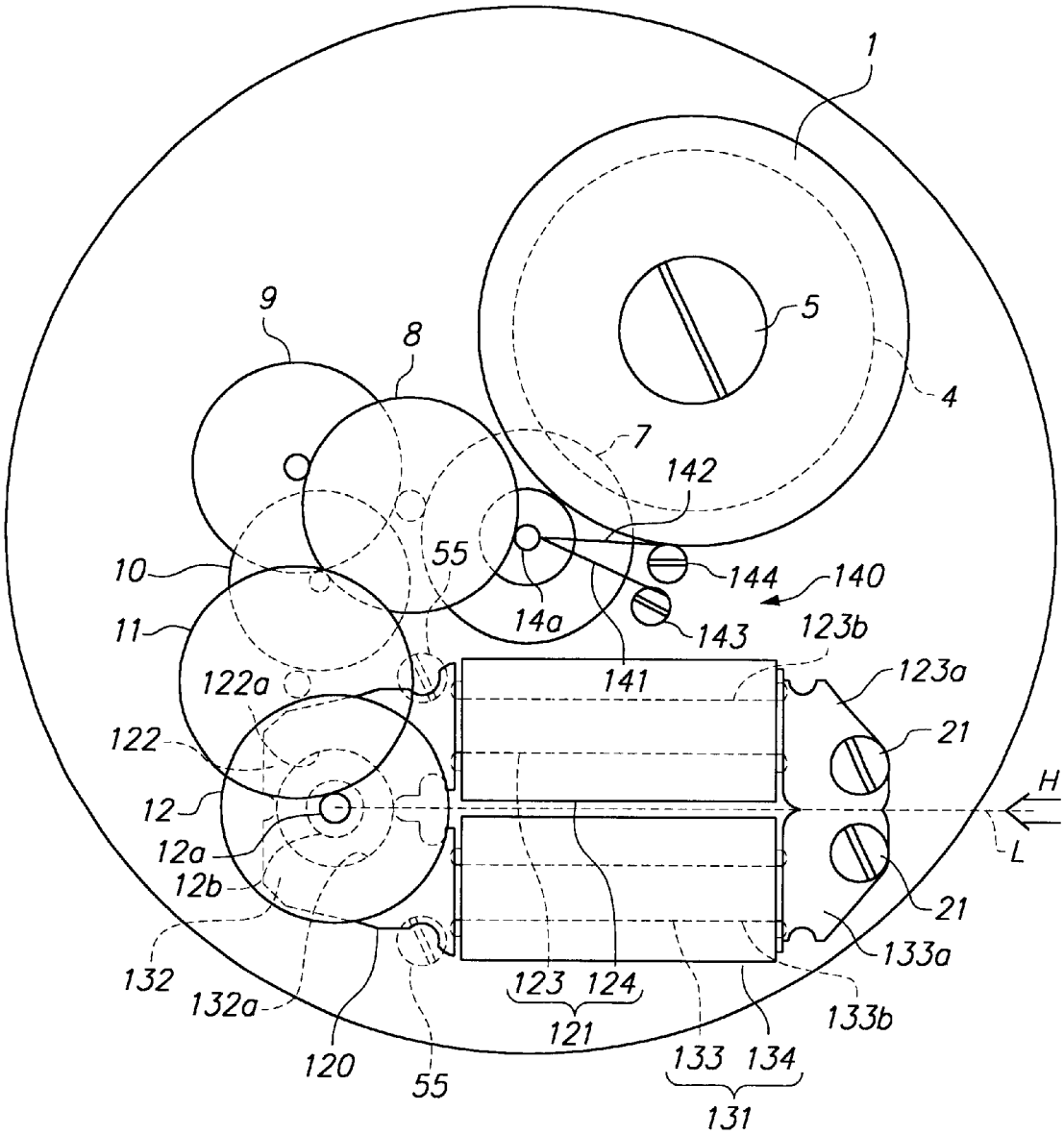
FIG. 1 is a plan view of an electronically controlled mechanical timepiece according to a first embodiment of the present invention.
Figure 2:
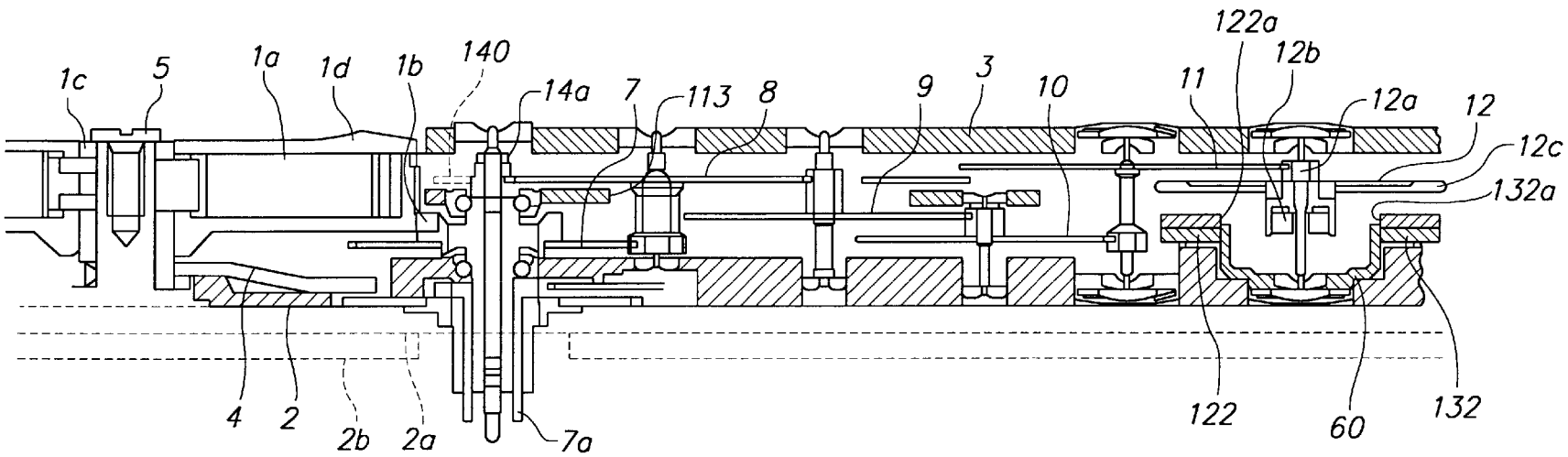
FIG. 2 is a sectional view showing the first embodiment.

FIGS. 1 and 2 show a first embodiment of the present invention. Components shown in the figures are identical to those in the conventional art except that the principal part of the structure of a power generator is different. Therefore, identical or corresponding components are denoted by the same reference numerals, and different components or components, of which an additional description will be given, are denoted by different reference numerals.

Referring to the figures, an electronically controlled mechanical timepiece has a barrel drum 1 composed of a mainspring 1*a* serving as a mechanical energy storing means, a barrel gear 1*b*, a barrel arbor 1*c*, and a barrel cover 1*d*. The mainspring 1*a* is fixed to the barrel gear 1*b* at the outer end, and to the barrel arbor 1*c* at the inner end. The cylindrical barrel arbor 1*c* is fitted on a supporting member formed on a main plate 2, is set by the supporting member and a barrel screw 5 so as to have vertical (in the axial direction) play, and rotates together with a ratchet wheel 4. The main plate 2 is provided with a date dial 2*a* and a disk-like dial 2*b*.

The rotation of the barrel gear 1*b* is transmitted via wheels 7 to 11 that constitute a speed-increasing gear train serving as a mechanical energy transmitting means at a speed increased 126,000 times in total. In this case, the wheels 7 to 11 are placed on different axes so as not to overlap with coils 124 and 134, which will be described later, thereby forming a torque transmitting path from the mainspring 1*a*.

A minute hand (not shown) for time indication is fixed to a cannon pinion 7*a* engaged with a center wheel and pinion 7, and a second hand (not shown) for time indication is fixed to a second pinion 14*a*. Therefore, in order for the center wheel and pinion 7 to rotate at 1 rph and for the second pinion 14*a* to rotate at 1 rpm, a rotor 12 is controlled so as to rotate at 5 rps. At this time, the barrel arbor 1*b* rotates at 1/7 rph.

Backlash of the second pinion 14*a* deviated from the torque transmitting path is reduced by a pointer regulating device 140 interposed between the barrel drum 1 and the coil 124. The pointer regulating device 140 comprises a pair of linear restricting springs 141 and 142 surface-treated by Teflon coating, intermolecular connection coating, or by other methods, and collets 143 and 144 fixed to a center wheel bridge 113 so as to support the base ends of the restricting springs 141 and 142.

The electronically controlled mechanical timepiece includes a power generator 120 composed of the rotor 12 and coil blocks 121 and 131. The rotor 12 comprises a rotor pinion 12*a*, a rotor magnet 12*b*, and a rotor inertia disk 12*c*. The rotor inertia disk 12*c* serves as a largest-diameter member in the rotor 12.

The coil blocks 121 and 131 are formed by winding coils 124 and 134 around stators (cores, magnetic cores) 123 and 133 that are made by stacking thin plates of the same shape. The stators 123 and 133 include core stator portions 122 and 132 placed adjacent to the rotor 12, core winding portions 123*b* and 133*b* with the coils 124 and 134 wound thereon, and core magnetic conducting portions 123*a* and 133*a* connected to each other, which are integrally formed.

The stators 123 and 133, that is, the coils 124 and 134, are placed in parallel with each other. The rotor 12 is constructed so that its center shaft lies along a boundary line L between the coils 124 and 134 on the side of the core stator portions 122 and 132. The core stator portions 122 and 132 are symmetrically placed with respect to the boundary line L.

In this case, a resin bush 60 is placed in stator holes 122*a* and 132*a* of the stators 123 and 133 where the rotor 12 is disposed, as shown in FIG. 2. Resin eccentric pins 55 are placed at the longitudinal centers of the stators 123 and 133, that is, between the core stator portions 122 and 132 and the core magnetic conducting portions 123*a* and 133*a*. When the eccentric pins 55 are turned, the core stator portions 122 and 132 of the stators 123 and 133 can be contacted with the bushing 60, and can be thereby exactly and easily positioned. Moreover, the side faces of the core magnetic conducting portions 123*a* and 133*a* can be reliably put into contact with each other.

The coils 124 and 134 have the same number of turns. In this embodiment, "the same number of turns" encompasses not only a case in which the numbers of turns are completely identical to each other, but also a case in which they are different to a degree so that it is negligible compared with the entire coil, for example, they are different by several hundreds of turns.

The core magnetic conducting portions 123*a* and 133*a* of the stators 123 and 133 are connected so that the side faces thereof contact with each other. The lower sides of the core magnetic conducting portions 123*a* and 133*a* are in contact with a yoke (not shown) placed over the core magnetic conducting portions 123*a* and 133*a*. Two magnetic conducting paths, a magnetic conducting path passing on the side faces of the core magnetic conducting portions 123*a* and 133*a* and a magnetic conducting path passing through the yoke disposed between the lower sides of the core magnetic conducting portions 123*a* and 133*a*, are thereby formed in the core magnetic conducting portions 123*a* and 133*a*. The stators 123 and 133 form an annular magnetic circuit. The coils 124 and 134 are wound in the same direction from the core magnetic conducting portions 123*a* and 133*a* of the stators 123 and 133 toward the core stator portions 122 and 132.

The ends of the coils 124 and 134 are connected to coil lead terminals (not shown) provided on the core magnetic conducting portions 123*a* and 133*a* of the stators 123 and 133.

In a case in which the electronically controlled mechanical timepiece thus configured is used, when an external magnetic field H (FIG. 1) is applied to the coils 124 and 134, since it is applied in the same direction to the coils 124 and 134 placed in parallel, it is applied in opposite directions with respect to the winding directions of the coils 124 and 134. For this reason, voltages produced in the coils 124 and 134 due to the external magnetic field H act so as to cancel each other, which can reduce the influence thereof.

Figure 3:
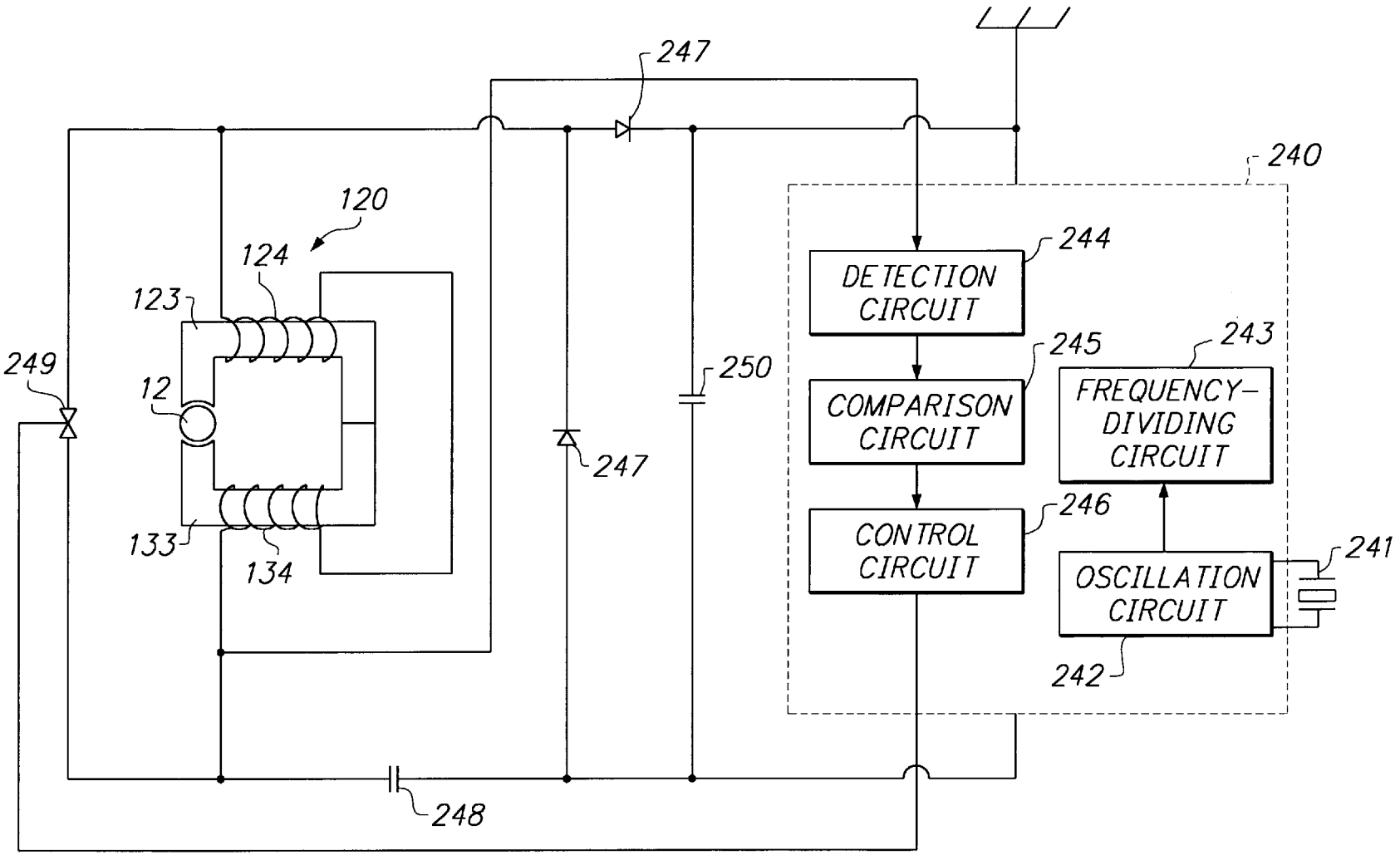
FIG. 3 is a circuit block diagram showing a connection form between a power generator and an electronic circuit in the first embodiment.

The coils 124 and 134 connected in series also serve to generate electromotive force, to detect the rotation of the rotor 12, and to control the rotation of the power generator 120, as shown in FIG. 3. That is, an electronic circuit 240 composed of ICs is driven by electromotive force from the coils 124 and 134 so as to detect and control the rotation. The electronic circuit 240 comprises an oscillation circuit 242 for driving a quartz oscillator 241, a frequency-dividing circuit 243 for generating reference frequency signals serving as time signals based on clock signals generated in the oscillation circuit 242, a detection circuit 244 for detecting the rotation of the rotor 12, a comparison circuit 245 for comparing the rotation cycle obtained by the detection circuit 244 and the reference frequency signals and outputting a difference therebetween, and a control circuit 246 for transmitting a control signal for braking the power generator 120 in accordance with the difference. A clock signal may be generated by using various reference oscillation sources or the like instead of the quartz oscillator 241.

The circuits 242 to 246 are driven by electrical power generated by the coils 124 and 134 connected in series. When the rotor 12 of the power generator 120 is rotated in one direction in response to the rotation from. the gear train, alternating-current output is produced in the coils 124 and 134. The output is boosted and rectified by a boosting and charging circuit composed of diodes 247 and a capacitor 248, the rectified direct current charges a storage capacitor 250, and the capacitor 250 drives the control circuit (electronic circuit) 240.

A part of the alternating-current output from the coils 124 and 134 is fetched as a detection signal for the rotation cycle of the rotor 12, and is input to the detection circuit 244. The output from the coils 124 and 134 takes an exactly sinusoidal waveform in every rotation cycle. Therefore, the detection circuit 244 subjects this signal to A/D conversion into a time-series pulse signal, the comparison circuit 245 compares the detection signal with the reference frequency signal, and the control circuit 246 transmits a control signal in accordance with the difference to a short (closed-loop) circuit 249 functioning as a brake circuit for the coils 124 and 134.

Based on the control circuit from the control circuit 246, the short circuit 249 short-circuits both ends of the coils 124 and 134 to apply a short brake, thereby governing the rotation cycle of the rotor 12.

Figure 4:
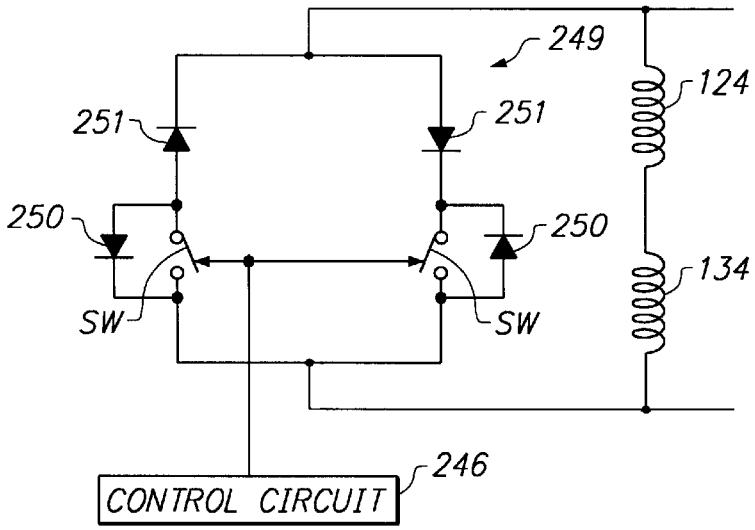
FIG. 4 is a circuit diagram of a short circuit shown in FIG. 3.

The short circuit 249 is, as shown in FIG. 4, constructed by a bidirectional switch composed of a pair of diodes 251 for passing currents therethrough in opposite directions, switches SW connected to the diodes 251 in series, and parasitic diodes 250 connected to the switches SW in parallel. This allows brake control using all the alternating-current output waves from the coils 124 and 134, and ensures a high degree of braking.

Next, the most characteristic structures of this embodiment will be described below with reference to FIG. 5.

In the electronically controlled mechanical timepiece of this embodiment, air viscosity resistance arises between the rotor inertia disk 12*c* and the stators 123 and 133 (more exactly, the core stator portions 122 and 132) serving as counter components closely facing the rotor inertia disk 12*c* in the axial direction. In this case, since the flow of air between the rotor inertia disk 12*c* and the core stator portions 122 and 132 can be regarded as Couette flow, the shear stress $\tau$ of the air layer corresponding to air viscosity resistance is given by the following formula (1):

$$\tau=\mu U/h \tag{1}$$

where $\mu$ represents the viscosity of air, U represents the rotation speed of the rotor 12, and h represents the gap between the rotor inertia disk 12*c* and the core stator portions 122 and 132.

The load torque T due to the shear stress $\tau$ (air viscosity resistance) is generally given by the following formula (2), although it slightly varies depending on the planar shape of the core stator portions 122 and 132:

$$T=\tau sr=\mu U/h\ sr \tag{2}$$

where S represents the area of a portion where the rotor inertia disk 12*c* and the core stator portions 122 and 132 overlap, and r represents the distance from the center of rotation of the rotor 12 to a portion where the rotor inertia disk 12*c* and the core stator portions 122 and 132 overlap in a plane.

Figure 5:
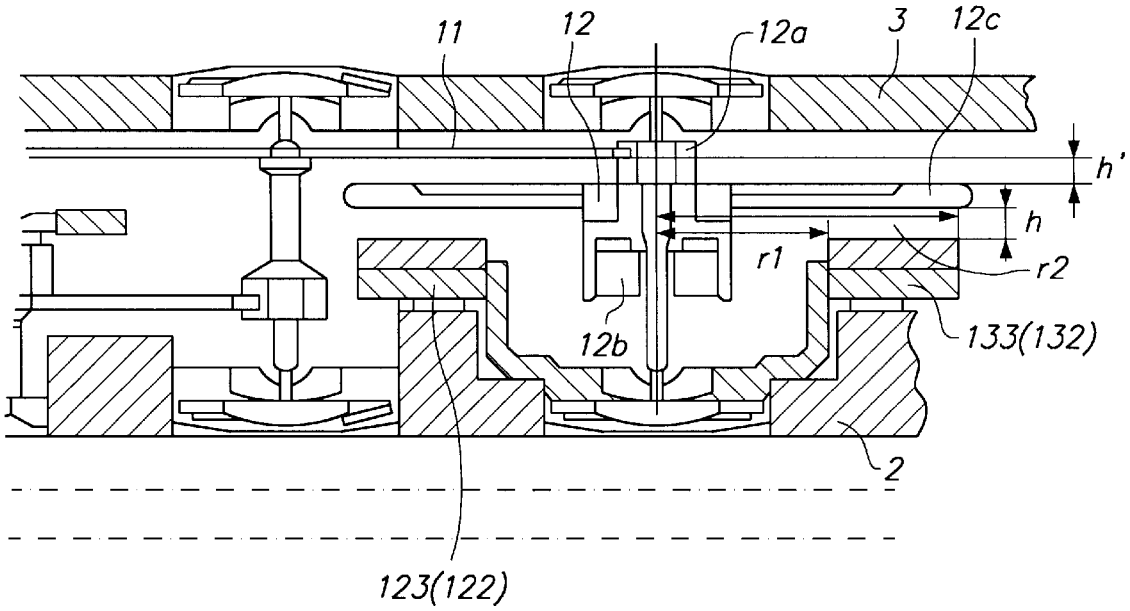
FIG. 5 is an enlarged sectional view showing the principal part of the embodiment of the present invention.

Furthermore, when $\omega$ represents the angular velocity of the rotor 12, f represents the rotational frequency, and $\pi$ represents the ratio of the circumference of a circle to its diameter, the rotation speed $U=r\cdot\omega=r\cdot 2\pi f$. When the area S is a small area increased by dr in the radial direction from the distance $r_1$ to the portion where the rotor inertia disk 12*c* and the core stator portions 122 and 132 overlap in a plane, the load torque $T_{rz}$ in the entire portion where the rotor 12 and the core stator portions 122 and 132 overlap is given by the following formula (3):

$$\begin{aligned} T_{rz} &= \int\left(\frac{\mu r_1}{h} r\cdot 2\pi f\cdot 2\pi\right)dr = \frac{4\pi^2 f\mu}{h}\int r^3 dr \\ &= \frac{4\pi^2 f\mu}{h}\left[\frac{1}{4}r^4\right]_{r_1}^{r_2} = \frac{\pi^2 f\mu}{h}(r_2^4 - r_1^4) \end{aligned} \tag{3}$$

where $r_2$ represents the distance from the center of rotation of the rotor 12 to the outer periphery of the portion where both the components overlap, as shown in FIG. 5.

Therefore, the gap h is expressed by the following formula (4), based on the above formula (3):

$$h = \frac{\pi^2 f\mu}{T_{rz}}(r_2^4 - r_1^4) \tag{4}$$

When the mainspring 1*a* is used as the mechanical energy storing means, as in this embodiment, the output torque at the end of the period of operation when the mainspring 1*a* is completely unwound falls to half the maximum output torque. In the electronically controlled mechanical timepiece, magnetic loss, friction loss, and energy loss in the control circuit constitute a large proportion of the entire energy loss. For this reason, when the maximum output torque of the mainspring 1*a* to be transmitted to the rotor 12 is $T_{rzmax}$, the load torque $T_{rz}$ due to air viscosity resistance between the rotor 12 and the core stator portions 122 and 132 must be set to be equal to or less than 1/10, more preferably 1/20 to 1/40, of the maximum output torque $T_{rzmax}$ ($T=1/10 \cdot T_{rzmax}$), as described above with reference to the graph shown in FIG. 14.

Therefore, the gap h shown in FIG. 5 is determined by the following formulas (5) and (6) in which K represents a coefficient, and this makes it possible to reduce air viscosity resistance, to limit the load torque $T_{rz}$, and to reduce energy loss of the mainspring 1*a:*

$$h = \frac{\pi^2 f \mu}{K T_{rz\max}} (r_2^4 - r_1^4) \tag{5}$$

$$K \leqq 1/10 \tag{6}$$

As shown in FIG. 5, a gap h' between the rotor inertia disk 12*c* and a gap of the sixth wheel and pinion 11 is set to be smaller than the gap h between the rotor inertia disk 12*c* and the stators 123 and 133 (h'<h), thereby reducing the thickness of the timepiece.

This embodiment described above provides the following advantages:

1) In the electronically controlled mechanical timepiece of this embodiment, the gap h between the rotor inertia disk 12*c* and the stators 123 and 133 is set when the coefficient K is 1/10 or less so that the load torque $T_{rz}$ due to air viscosity resistance between these components is equal to or less than 1/10 of the maximum output torque $T_{rzmax}$ of the mainspring 1*a* transmitted to the rotor 12. This makes it possible to limit the energy loss of the mainspring 1*a,* and to thereby extend the period of operation of the timepiece.

2) When the coefficient K is set to be 1/20 to 1/40 or less, the load torque $T_{rz}$ at the rotor 12 can be further reduced by increasing the gap h, and the period of operation of the timepiece can be further extended. Moreover, it is possible to prevent the gap h from becoming larger than necessary, and to prevent the timepiece from becoming excessively thick. This does not hinder thickness reduction.

3) Since the gap h' between the rotor inertia disk 12*c* and the sixth wheel and pinion 11 meshed therewith is set to be smaller than the gap h, it is possible to reduce the thickness of the timepiece, and to promote thickness reduction. In this case, since the portions where the sixth wheel and pinion 11 and the rotor inertia disk 12*c* overlap move in the same direction in response to the meshed rotation thereof, the relative speed at the overlapping portions does not become so high, and air viscosity resistance produced between the components does not cause any problems, even when the gap h' is small.

4) The stators 123 and 133 are formed of separate components, and do not have a fragile portion due to a cantilevered structure of a stator hole, and an easily deformable portion like an outside notch. Therefore, handling is facilitated, handling ability in the processes can be improved, and the yield can be prevented from decreasing.

5) Since the stators 123 and 133 have the same shape, a coil can be wound on identical components turned inside out, the components can be commonly used, and the number of components can be reduced. For this reason, it is possible to reduce manufacturing cost and parts cost, and to facilitate handling.

6) Since the stators 123 and 133 of the same shape are placed symmetrically and the number of turns of the coils 124 and 134 on the stators 123 and 133 are the same, the same number of magnetic fluxes pass through the two coils 122 and 132 due to AC noise generated outside the timepiece or the like. This can cancel the influence of external noise, and to allow an electronically controlled mechanical timepiece that is highly resistant to noise to be constructed.

7) Since the degree of freedom in arrangement and design of the second to sixth wheel and pinions 7 to 11 can be enhanced by placing the wheels 7 to 11 on different axes, the wheels 7 to 11 are placed at a distance from the rotor 12, for example, by placing the second pinion 14*a* outside the torque transmitting path, so that the wheels 7 to 11 can be placed at the positions so as not to overlap with the coils 124 and 134. Therefore, since the number of turns can be increased by increasing the thickness of the coils 124 and 134, it is possible to shorten the length of the coils 124 and 134 in the plane direction, that is, the magnetic path length, and to reduce core loss and to thereby extend the period of operation of the mainspring 1*a*.

8) Since the rotor 12 is placed on the boundary line L and the stators 123 and 133 are placed symmetrically, it is possible to shorten the magnetic path at the core stator portions 122 and 132, to thereby shorten the magnetic path length, and to reduce core loss.

9) Since the core magnetic conducting portions 123*a*and 133*a* constitute two magnetic conducting paths, it is possible to decrease and stabilize magnetic resistance. Stabilized magnetic resistance can also stabilize induced voltage, power generation, and braking. Furthermore, it is possible to reduce leakage magnetic fluxes, and to reduce eddy loss in the metal components.

10) Since the eccentric pins 55 and the bush 60 are provided, the stators 123 and 133 can be positioned while the rotor 12 is placed inside the stator holes 53. For example, the stators 122 and 123 can be easily placed at the most appropriate positions to the rotor 12 immediately before shipping of products, and positioning accuracy can be improved further.

11) Since the eccentric pins 55 are formed of a softer resin component than the stators 123 and 133, it is possible to prevent the stators 123 and 133 from being broken by the eccentric pins 55.

12) Since the eccentric pins 55 are placed between the core stator portions 122 and 123 and the core magnetic conducting portions 123*a* and 133*a,* the core stator portions 122 and 132 can be positioned and the contact state of the core magnetic conducting portions 123*a* and 133*a* can be adjusted by using a single eccentric pin provided for each of the stators 123 and 133. This makes it possible to reduce the number of the eccentric pins 55, to simplify the structure, and to reduce the costs.

13) Since magnetic noise due to the external magnetic field H can be reduced, it is unnecessary to provide an antimagnetic plate in a component of the movement, such as the dial 2*b,* of the electronically controlled mechanical timepiece, and to use an antimagnetic material for exterior components. For this reason, the cost can be reduced, and the reduction in size and thickness of the movement can be achieved because the antimagnetic plate and the like are unnecessary. Moreover, since the arrangement of the components is not limited by the exterior components, the degree of freedom in design is enhanced, and it is possible to provide an electronically controlled mechanical timepiece that is superior in graphical design ability and manufacturing efficiency.

14) Since the second pinion 14*a* is deviated from the torque transmitting path, it does not need torque transmitting gears and the like that overlap with the barrel drum 1. Therefore, it is thereby possible to increase the width of the mainspring 1*a* (the size in the direction parallel to the axis of the barrel arbor 1*c*), and to further extend the period of operation of the mainspring 1*a* while maintaining the entire thickness of the timepiece.

[Second Embodiment]

Figure 6:
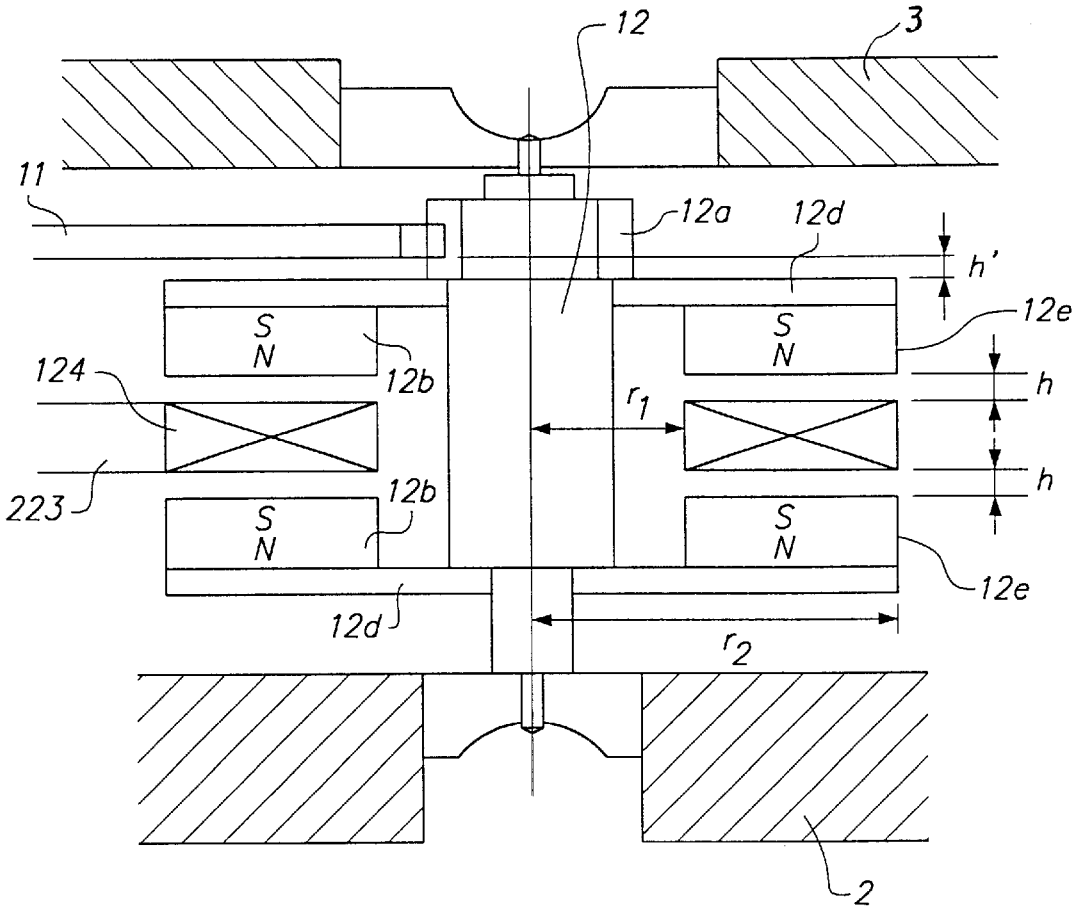
FIG. 6 is an enlarged sectional view showing the principal part of an electronically controlled mechanical timepiece according to a second embodiment of the present invention.

A second embodiment of the present invention will be described with reference to FIG. 6. In this embodiment, components and the like similar to those in the above-described first embodiment are denoted by the same numerals, and a description thereof is omitted. Differences from the first embodiment will be described below.

A rotor 12 adopted in this embodiment has a structure similar to that of a brushless motor (a flat torque motor type). That is, the rotor 12 includes rotor members 12*e* in which a plurality of rotor magnets 12*b* are arranged around the rotation axis on a disk-like back yoke 12*d,* and the rotor members 12*e* are placed to face each other in the axial direction. In each of the rotor members 12*e,* the rotor magnets 12*b* are arranged so that the directions of poles of the adjoining rotor magnets 12*b* are different from each other. A substrate 223 serving as a counter component is interposed between the rotor members 12*e,* and a plurality of coils 124 are arranged in the circumferential direction at the positions corresponding to the rotor magnets 12*b.* Since the disk-like rotor members 12*e* also serve as inertia disks in this rotor 12, the rotor inertia disk 12*c* as in the first embodiment is not provided.

That is, in this embodiment, the rotor members 12*e* serve as reference components when defining a gap h with respect to the counter component, in a manner similar to that of the rotor inertia disk 12*c* of the first embodiment, and also serve as largest-diameter members in the rotor 12. For this reason, the gap h between the rotor members 12*e* (rotor magnets 12*b*) and the substrate 223 closely opposed thereto is set by the above-described formulas (5) and (6). A gap h' between the rotor member 12*e* and a sixth wheel and pinion 11 is also set to be smaller than the gap h.

Therefore, this embodiment can similarly provide the above-described advantages 1) to 3).

A distance between the lower rotor member 12*e* in the figure and a main plate 2 and a distance between the upper rotor member 12*e* and a train wheel bridge 3 are also set as in the above formulas (5) and (6). Accordingly, it is possible to rotate the rotor 12 without any influences of air viscosity resistance due to the main plate 2 and the train wheel bridge 3.

[Third Embodiment]

In an electronically controlled mechanical timepiece according to a third embodiment of the present invention, the pressure inside a movement, which comprises a mainspring, a gear train, and a power generator, is reduced, although this is not shown.

Such an electronically controlled mechanical timepiece can be obtained, for example, by reducing the pressure inside an airtight transmissive casing, and assembling the movement, incorporating the movement into the casing, and mounting a rear cover to the casing with the hand put into the casing.

Since air density inside the movement is low in such an embodiment, it is possible to reduce air viscosity resistance described above, and to substantially extend the period of operation of the timepiece.

Since air viscosity resistance can be reduced, thickness reduction of the timepiece can be further promoted by decreasing the gap between the rotor and the stators.

[Fourth Embodiment]

Figure 7:
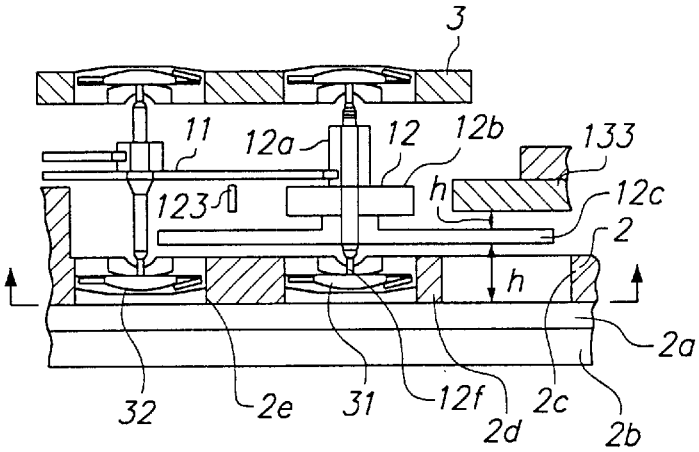
FIG. 7 is a sectional view showing the principal part of an electronically controlled mechanical timepiece according to a fourth embodiment of the present invention.
Figure 8:
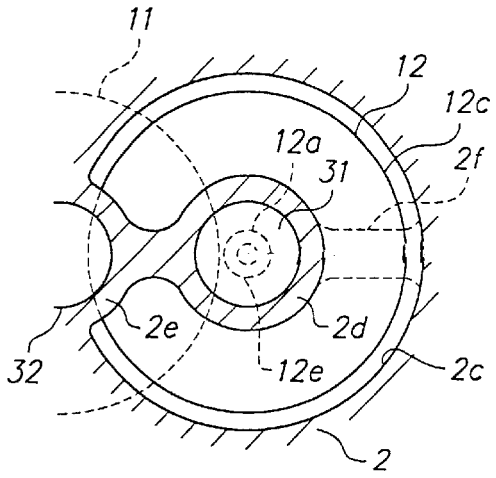
FIG. 8 is a plan view showing the fourth embodiment.

FIGS. 7 and 8 show the principal part of an electronically controlled mechanical timepiece according to a fourth embodiment of the present invention.

In the electronically controlled mechanical timepiece of this embodiment, a rotor 12 is constructed so that a rotor inertia disk 12*c* is interposed between stators 123 and 133 and a main plate 2.

In this case, the main plate 2 serving as a proximity component in proximity contact with the rotor inertia disk 12*c* is provided with a through opening 2*c* extending in the axial direction so as to face the rotor inertia disk 12*c*. At the center of the opening 2*c,* a holding section 2*d* is provided for a combined bearing 31 that receives a tenon 12*f* at the bottom end of the rotor 12 in FIG. 7. The holding section 2*d* is connected to a holding section 2*e* formed for a combined bearing 32 of a sixth wheel and pinion 11 disposed adjacent thereto. In such a configuration, since the main plate 2 has the opening 2*c,* nearly the entire surface of the rotor inertia disk 12*c* on the side of the main plate 2, excluding the holding sections 2*d* and 2*e* and a connected portion therebetween, faces a date dial 2*a* disposed beyond the opening 2*c*. Since the holding sections 2*d* and 2*e* and the connected portion therebetween overlap, in a plane, with the rotor inertia disk 12*c* in a considerably small area, even when they are placed close to the rotor inertia disk 12*c,* the load torque $T_{rz}$ is not increased.

Therefore, in this embodiment, the calendar disk 2*a* corresponds to the counter component of the present invention, and the gap h between the rotor inertia disk 12*c* and the date dial 2*a,* the gap h between the rotor inertia disk 12*c* and the stators 123 and 133, and the like are set based on the formulas (5) and (6) described in the first embodiment (this also applies to a gap h shown in the figures illustrating the following embodiments).

According to this embodiment, since the main plate 2 closest to the rotor inertia disk 12*c* has the opening 2*c* at the position opposing the rotor inertia disk 12*c,* the date dial 2*a* is substantially opposed to the rotor inertia disk 12*c*. Therefore, the above advantage 1) can be obtained by reliably ensuring the gap h between the rotor inertia disk 12*c* and the date dial 2*a*.

In this case, the above advantage is more pronounced when the area of the opening 2*c* is equal to or more than ½, more preferably ⅔, of the area of the portion where the main plate 2 and the rotor inertia disk 12*c* overlap in a plane without the opening 2*c* therebetween.

The entire main plate 2 can be placed at a shorter distance than the gap h from the rotor 12 without increasing the load torque $T_{rz}$ of the rotor 12, and the efficiency of layout in the component layout space inside the timepiece can be enhanced, which can further reduce the thickness of the timepiece.

While the holding section 2*d* at the center of the opening 2*c* is connected to the holding section 2*e* of the sixth wheel and pinion 11 in this embodiment, a connecting portion 2*f* may be provided to connect the holding section 2*d* and another inner peripheral portion of the opening 2*c,* as shown by dotted chain lines in FIG. 8 serving as a plan view showing the section shown in FIG. 7. It may be arbitrarily determined, in consideration of required strength of the main plate 2 and the like, to which portion of the opening 2*c* the holding section 2*d* is to be connected, at how many points they are to be connected, and the like. When the holding section 2*e* of the sixth wheel and pinion 11 is provided so as to protrude toward the holding section 2*d,* as in this embodiment, the area of the portion overlapping with the rotor inertia disk 12*c* in a plane can be further reduced by connecting the holding sections 2*e* and 2*e.*

[Fifth Embodiment]

Figure 9:
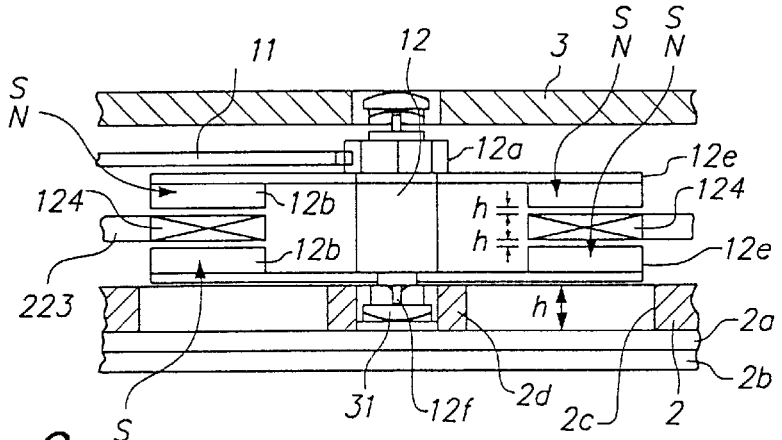
FIG. 9 is a sectional view showing the principal part of an electronically controlled mechanical timepiece according to a fifth embodiment of the present invention.

According to a fifth embodiment shown in FIG. 9, a main plate 2 of an electronically controlled mechanical timepiece including a flat torque motor type rotor 12 is provided with an opening 2*c* that is nearly similar to that in the above fourth embodiment. While a connected portion lies between a holding section 2*d* and the inner rim of the opening 2*c,* it is not shown in FIG. 9.

In such an electronically controlled mechanical timepiece, a component closest to the rotor 12 (a lower rotor member 12*e*) is a main plate 2. Since the main plate 2 also has the opening 2*c,* a date dial 2*a* at a great distance from the rotor member 12*e* substantially faces the lower rotor member 12*e,* and corresponds to the counter component of the present invention.

This embodiment also provides advantages similar to those in the fourth embodiment. That is, it is possible to reduce the load torque $T_{rz}$ of the rotor 12 due to air viscosity resistance, to place the entire main plate 2 closer to the rotor member 12*e,* and to thereby reduce the thickness of the timepiece.

In this case, the above advantage is also pronounced when the area of the opening 2*c* is equal to or more than ½, more preferably ⅔, of the area of the portion where the main plate 2 and the rotor member 12*e* overlap in a plane without the opening 2*c* therebetween, as in a manner similar to that in the fourth embodiment. In particular, when the inner rim of the opening 2*c* is formed to have a larger diameter than that of the outer rim of the rotor member 12*e,* since the rotation speed is highest on the outermost periphery of the rotor member 12*e,* the advantage of reducing air viscosity resistance is enhanced.

[Sixth Embodiment]

Figure 10:
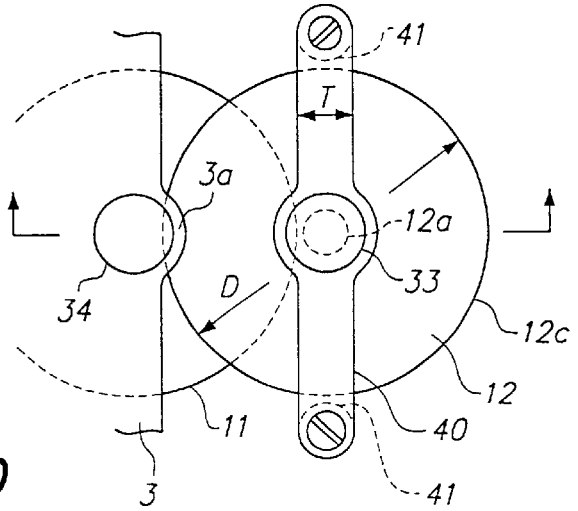
FIG. 10 is a plan view showing the principal part of an electronically controlled mechanical timepiece according to a sixth embodiment of the present invention.
Figure 11:
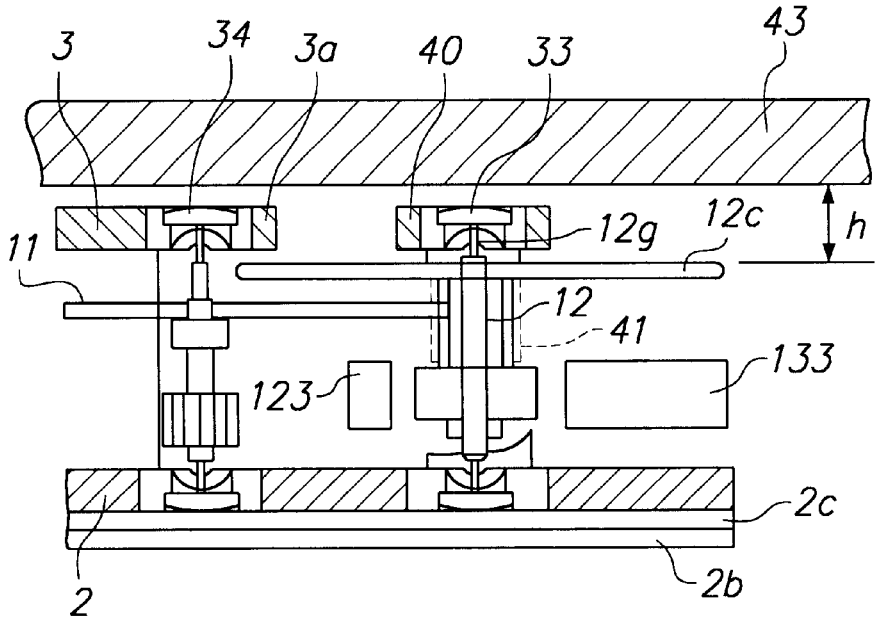
FIG. 11 is a sectional view showing the sixth embodiment.

In a sixth embodiment shown in FIGS. 10 and 11, a gear train including a center wheel and pinion (not shown) to a sixth wheel and pinion 11 are supported by a main plate 2 and a train wheel bridge 3, while a rotor 12 is supported at one end by the main plate 2 and is supported at the other end by a supporting member 40 separate from the train wheel bridge 3.

The supporting member 40 extends between a pair of column members 41, such as pins, (shown by dotted chain lines in the figure) standing on the main plate 2 on both sides of the rotor 12 in the radial direction, in a bridge form (in the form of a gate in cross section including the column members 41), and the supporting member 40 is screwed thereto. A combined bearing 33 is held at approximately the longitudinal center of the supporting member 40, and is engaged with a tenon 12*g* of the rotor 12. The supporting member 40 has a width T set to be equal to or less than ½ of the diameter D of a rotor inertia disk 12*c*. While the supporting member 40 has a sufficient strength to reliably support the rotor 12, it overlaps with the rotor inertia disk 12*c* in a small area. In this case, it is preferable that the area of the overlapping portion be equal to or less than ½, more preferably ⅓, of the area of a portion where the supporting member 40 overlaps with the entire rotor inertia disk 12*c*.

In the train wheel bridge 3, a holding section 3*a* for holding a combined bearing 34 for the sixth wheel and pinion 11 protrudes so as to overlap with the rotor inertia disk 12*c* in a plane. The size of the holding section 3*a* is set so as to reliably hold the combined bearing 34 and so that the amount of protrusion is minimized, and is set so that the area of the portion overlapping with the rotor inertia disk 12*c* is as small as possible.

According to this embodiment described above, since the supporting member 40 for supporting the rotor 12 is provided separately from the train wheel bridge 3, it can be made as a component having no wide planar portion. Therefore, a rear cover 43 at a great distance from the rotor inertia disk 12*c* can serve as a counter component closely facing the rotor inertia disk 12*c* in the axial direction, which can reliably ensure the gap h.

While the supporting member 40 extends between the column members 41 in a bridge form so that it is shaped like a gate in cross section including the column members 41 in this embodiment, it may be shaped like a gate in cross section, for example, by leaving a cylindrical portion when cutting the main plate 2 and extending the supporting member 40 on the open side of the cylindrical portion. In this case, however, since air viscosity resistance may be increased between the outer peripheral end face of the rotor inertia disk 12*c* and the inner surface of the cylindrical portion connected thereto in the circumferential direction, it is preferable to shape the supporting member 40 like a gate in cross section by using the column members 41 such as pins.

While the supporting member 40 is bridge-shaped and is fixed to the column members 41 at both ends in this embodiment, for example, such a single column member 41 may be formed to stand and one end of the supporting member 40 may be screwed to the standing column member 41. In such a case, a rodlike component is fixed by the column member 41 in a cantilevered manner.

A rotor, in which the rotor inertia disk is close to the main plate, may be supported at one end by the train wheel bridge, and may be supported at the other end by a supporting member fixed to the train wheel bridge.

Furthermore, a flat torque motor type rotor, besides the rotor including the rotor inertia disk, may be supported by a supporting member as in this embodiment.

[Seventh Embodiment]

Figure 12:
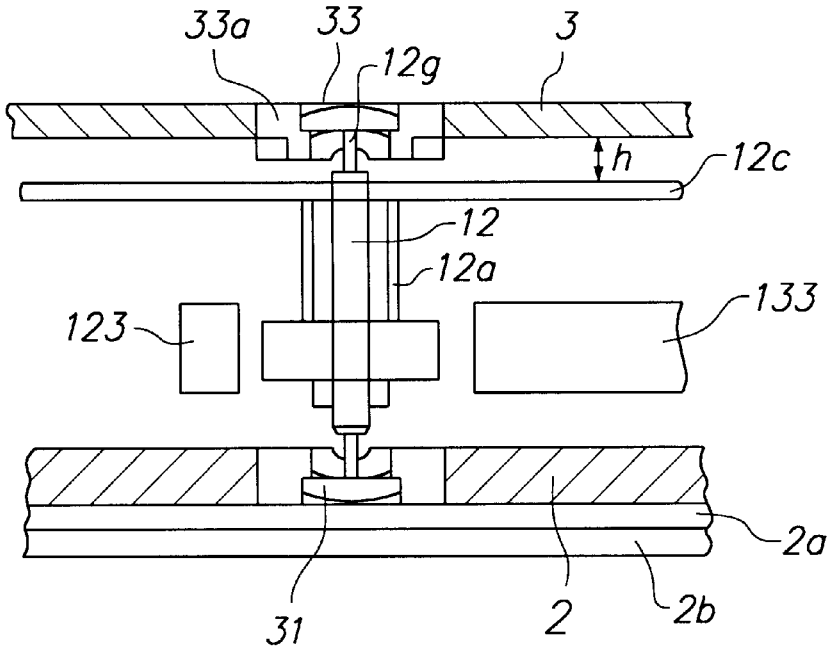
FIG. 12 is a sectional view showing the principal part of an electronically controlled mechanical timepiece according to a seventh embodiment of the present invention.

In a seventh embodiment shown in FIG. 12, the thickness of a train wheel bridge 3 (supporting member) most closely facing a rotor inertia disk 12*c* is smaller than that of a combined bearing 33, and a surface of the train wheel bridge 3 facing the rotor inertia disk 12*c* is disposed at a greater distance in the axial direction from the rotor inertia disk 12*c* than a facing surface of the combined bearing 33.

In the combined bearing 33, the thickness of a portion of an outer peripheral member 33*a,* which forms the outer periphery, in contact with the train wheel bridge 3 is similarly small in accordance with the thickness of the train wheel bridge 3, and the thickness at the center is large as in the conventional art. For this reason, it is unnecessary to change the size and shape of the components inside the outer peripheral member 33*a,* and this makes it possible to appropriately maintain the engaged state between the rotor 12 and a tenon 12*g*.

In this embodiment, since the train wheel bridge 3 at a greater distance (apart in the radial direction) from the center of rotation of the rotor 12 than the combined bearing 33 closer to the center of rotation is also disposed at a great distance from the rotor inertia disk 12*c* in the axial direction, the gap h between the train wheel bridge 3 and the outer periphery of the rotor inertia disk 12*c* can be increased while appropriately maintaining the engaged state between the combined bearing 33 and the tenon 12*g* of the rotor 12 without any changes. For this reason, air viscosity resistance can be reliably reduced on the outer peripheral side where the peripheral velocity of the rotor inertia disk 12*c* increases, that is, in a portion where air viscosity resistance has a great influence, which can extend the period of operation of the timepiece.

While it is preferable that the area of the above-described thin center portion be small, when it is equal to or less than ⅓ of the projection area (in a case in which the rotor inertia disk 12*c* has an opening, a projection portion of the opening is included in the projection area) of the rotor inertia disk 12*c* in plan view, a great advantage is provided which reduces air viscosity resistance, because the portion is disposed on the side of the center of rotation.

The outer shape of the outer peripheral member 33*a* of the combined bearing 33 need not always be protruded downward in cross section, and it may be of a normal type having a rectangular cross section, as shown by dotted chain lines in the figure.

While the train wheel bridge 3 is described as a supporting member most closely facing the rotor inertia disk 12*c* in this embodiment, when the rotor inertia disk 12*c* is disposed close to the main plate 2, the main plate 2 may be placed at a greater distance from the rotor inertia disk 12*c* than the combined bearing 31 shown in FIG. 12.

By applying the main plate 2 and the train wheel bridge 3 with such a structure to an electronically controlled mechanical timepiece having a flat torque motor type rotor, similar advantages can be obtained.

[Eighth Embodiment]

Figure 13:
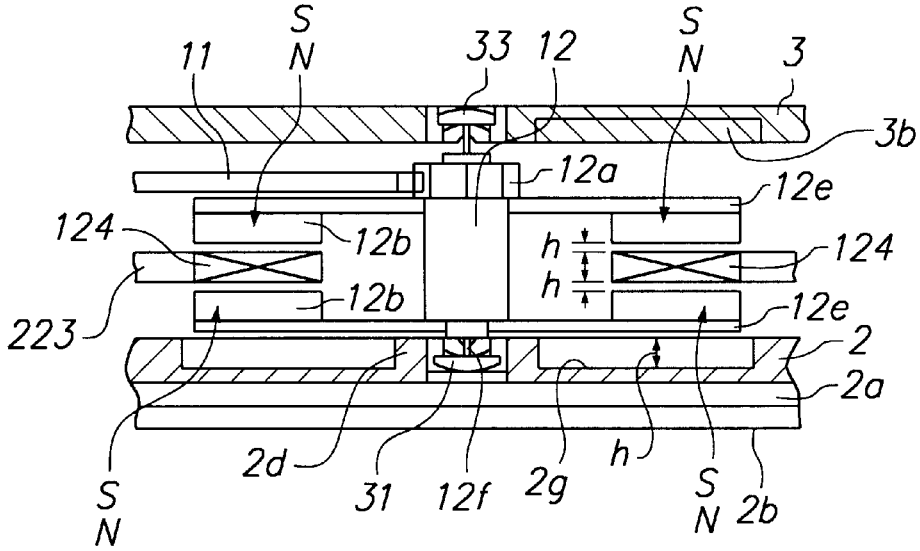
FIG. 13 is a sectional view showing the principal part of an electronically controlled mechanical timepiece according to an eighth embodiment of the present invention.

In an eighth embodiment shown in FIG. 13, a main plate 2 serving as a supporting member, which is fixed to most closely face a rotor 12 (a lower rotor member 12*e*) so as to support a tenon 12*f* of the rotor 12 on the lower side in the figure, has a holding section 2*d* that holds a combined bearing 31 for receiving the tenon 12*f* over the entire thickness range. On the periphery of the holding section 2*d*, a recess 2*g* is formed at a greater distance from the rotor member 12*e* than the holding section 2*d*.

According to this embodiment, since the main plate 2 has the holding section 2*d* for holding the combined bearing 31 over the entire thickness range, the strength for holding the combined bearing 31 can be reliably ensured. In this case, since the thick holding section 2*d* is provided close to the tenon 12*f* of the rotor 12, that is, at a position where the peripheral velocity of the rotor member 12*e* is low and air viscosity resistance is not severe, it does not act so as to shorten the period of operation of the timepiece. On the contrary, the main plate 2 can be more reliably separated from the outer peripheral side of the rotor member 12*e* by the recess 2*g* formed around the holding section 2*d*, and the gap h can be ensured.

In a case in which the upper rotor member 12*e* is closest to the train wheel bridge 3, a recess 3*b* may be formed in the train wheel bridge 3, as shown by dotted chain lines in the figure. In this case, air viscosity resistance can be substantially reduced by setting the areas of the recesses 2*g* and 3*b* to be equal to or more than ½, more preferably ⅔, of the area of the rotor member 12*e*.

Even when the main plate 2 and the train wheel bridge 3 including such recesses 2*g* and 3*b* are applied to an electronically controlled mechanical timepiece including a rotor with a rotor inertia disk, similar advantages can be obtained.

The present invention is not limited to the above embodiments, and encompasses other structures that can achieve the object of the invention. The present invention also encompasses the following modifications.

For example, while the structures concerning the electronically controlled mechanical timepiece other than the structure on the periphery of the power generator 120 are shown in the first embodiment, such structures and components concerning other portions are not limited to those in the first embodiment, and may be arbitrarily determined when carrying out the invention.

While the rotor inertia disk 12*c* of the rotor 12 is interposed between the stators 123 and 133 and the train wheel bridge 3 in the first embodiment, it may be interposed between the stators and the main plate, as shown in FIG. 7. In such a case, the gap between the rotor inertia disk and the stators or between the rotor inertia disk and the main plate may be set according to the above formulas (5) or (6).

While the gap h' is set to be smaller than the gap h in the first and second embodiments, the present invention also encompasses a case in which the gap h' is set to be larger than the gap h. However, it is preferable to make the setting as in these embodiments, because the thickness of the timepiece can be reduced without any consideration of the influence of air viscosity resistance.

The rotor having the rotor inertia disk according to the present invention also includes a type having no rotor magnets. In such a case, rotor magnets are provided in, for example, the sixth wheel and pinion or the like to be meshed with the rotor, and the power generator is constructed to include the sixth wheel and pinion.

The surface of the rotor inertia disk or the rotor member, which serves as the largest-diameter member of the present invention, facing the counter component, such as the main plate, need not be flat, and may have an opening. In such a case, since air at the opening on the side of the rotor rotates together with the rotor, even if the opening is formed in the rotor, a great advantage of reducing air viscosity cannot be obtained. However, since excess weight of the rotor is reduced by forming the opening, frictional loss at the bearing can be limited. In particular, when the opening is formed at the center of the rotor, the inertia of the rotor can be increased while limiting the weight, and this is advantageous. In this case, the advantage is more pronounced when the area of the opening is equal to or more than ½, more preferably ⅔, of the area of the rotor inertia disk or the rotor member.

The counter component of the present invention is not limited to the main plate, the train wheel bridge, the rear cover, and the like. For example, a wheel, which overlaps with the rotor inertia disk or the rotor member in a plane and rotates at a substantially lower speed than that of these members, of the wheels constituting the train wheel may serve as a counter component because it is regarded as being substantially stationary in contrast to the rotor inertia disk and the rotor member. In a timepiece having a kicking mechanism that kicks an arbitrary wheel to actuate the rotor, a lever in this kicking mechanism sometimes temporarily overlaps with and closely faces the rotor inertia disk or the rotor member in a plane when actuating the mechanism. Therefore, such a lever may be regarded as a counter component when it has an influence on the load torque of the rotor in connection with air viscosity resistance.

While the mainspring 1*a* is used as the mechanical energy storing means in the above embodiments, the mechanical energy storing means is not limited to the mainspring, and may include rubber, a spring, and a weight. When the electronically controlled mechanical timepiece is produced, not as a wristwatch, but as a large-scale clock, a fluid, such as compressed air, may serve as the mechanical energy storing means.

In the electronically controlled mechanical timepieces of the embodiments other than the sixth embodiment, components other than the train wheel, for example, an endless component, such as a timing belt or a chain, may be used as the mechanical energy transmitting means.

FIRST EXAMPLE

Figure 14:
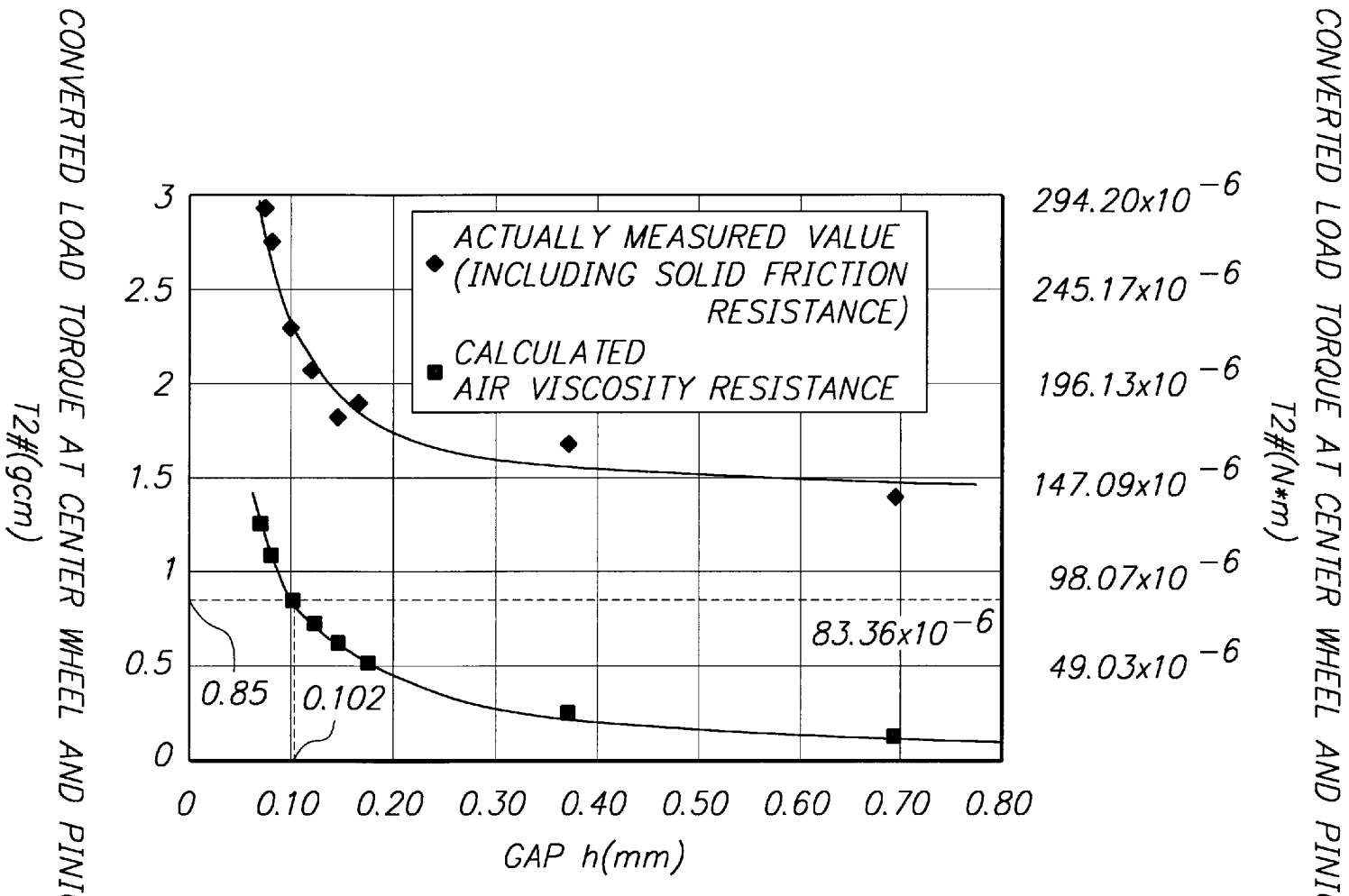
FIG. 14 is a graph showing a first example of the present invention.

As a first example of the present invention, based on the first embodiment, the load torque $T_{2\#}$ due to air viscosity resistance when the gap h changed, as shown in the following Table 1, was examined by calculation according to the above formula (3) and actual measurement. Table 1 and FIG. 14 show the relationship between the gap h and the load torque $T_{2\#}$. The load torque $T_{2\#}$ is obtained by converting the load torque $T_{rz}$ at the rotor 12 into the load torque produced in the center wheel and pinion 7. The formula (6) is a conversion formula. Herein, n represents the speed increasing ratio from the rotor 12 to the center wheel and pinion 7, which is 36,000 in this example, x represents the transmission efficiency per gear from the rotor 12 to the center wheel and pinion 7, which is 0.9 in this example, and y represents the number of engagements from the rotor 12 to the center wheel and pinion 7, which is 5 in this example. In table 1, a lower table shows values obtained by converting the values in an upper table into the International System of Units.

The conditions in this example are as follows:

graph shown in FIG. 14, it is recognized that these values depend on resistances other than air viscosity resistance, for example, mechanical friction in the gear train, and viscosity resistance of oil at the tenon.

Therefore, it is determined almost without doubt that the load torque $T_{rz}$ found by the formula (3) depends on air viscosity resistance.

Since the maximum output torque $T_{rzmax}$ is $0.0137\times10^{-6}$ N·m (a value obtained by converting 1.4 mgmm (a converted value at the center wheel and pinion is 8.5 gcm) into the International System of Units) in this example, this is satisfactory as long as the coefficient K is set so that the gap h is 0.102 mm or more, according to the above formulas (5) and (6). Regarding this, according to the graph shown in FIG. 14, when the gap h is less than 0.102 mm, the converted load torque $T_{2\#}$ at the center wheel and pinion rapidly increases above $83.36\times10^{-6}$ N·m (a value obtained by converting 0.85 gcm (a converted value at the rotor is 0.14 mgmm) into the International System of Units), and the load torque $T_{rz}$ at the rotor 12 due to air viscosity resistance exceeds 1/10 of the maximum output torque $T_{rzmas}$. This shows that air viscosity resistance has an adverse effect on the period of operation of the timepiece.

Conversely, when the gap h is 0.102 mm or more, since the load torque $T_{2\#}$ remains substantially stable and is sufficiently low, it is determined that the influence of air viscosity on the period of operation is negligible.

Accordingly, this example reveals that it is effective to set the gap h according to the above formulas (5) and (6).

TABLE 1

| Gap h (mm) | Converted load torque $T_{2\#}$ (gcm) at center wheel and pinion (calculated value) | Load torque $T_{2\#}$ (gcm) of center wheel and pinon (actually measured value) | Actually measured value − calculated value (gcm) | Converted load torque $T_{2\#}$ (N · m) at center wheel and pinion (calculated value) | Load torque $T_{2\#}$ (N · m) at center wheel and pinion (actually measured value) | Actually measured value − calculated value (N · m) |
|---|---|---|---|---|---|---|
| 0.070 | 1.2337006 | 2.93 | 1.696299 | $1.2098 \times 10^{-4}$ | $2.8733 \times 10^{-4}$ | $1.6635 \times 10^{-4}$ |
| 0.080 | 1.0794880 | 2.75 | 1.670512 | $1.0586 \times 10^{-4}$ | $2.6968 \times 10^{-4}$ | $1.6382 \times 10^{-4}$ |
| 0.102 | 0.8466572 | 2.29 | 1.443343 | $0.8303 \times 10^{-4}$ | $2.2457 \times 10^{-4}$ | $1.4154 \times 10^{-4}$ |
| 0.122 | 0.7078610 | 2.07 | 1.362139 | $0.6942 \times 10^{-4}$ | $2.0300 \times 10^{-4}$ | $1.3358 \times 10^{-4}$ |
| 0.146 | 0.5915003 | 1.82 | 1.2285 | $0.5801 \times 10^{-4}$ | $1.7848 \times 10^{-4}$ | $1.2047 \times 10^{-4}$ |
| 0.170 | 0.5079943 | 1.89 | 1.382006 | $0.4982 \times 10^{-4}$ | $1.8535 \times 10^{-4}$ | $1.3553 \times 10^{-4}$ |
| 0.376 | 0.2296783 | 1.68 | 1.450322 | $0.2252 \times 10^{-4}$ | $1.6475 \times 10^{-4}$ | $1.4223 \times 10^{-4}$ |
| 0.696 | 0.1240791 | 1.39 | 1.265921 | $0.1217 \times 10^{-4}$ | $1.3631 \times 10^{-4}$ | $1.2414 \times 10^{-4}$ |

$$T_{2?} = T_{rz} n \frac{1}{xy} \quad (7)$$

air viscosity $\mu$: 1.853 Pa·s (a value obtained by converting $0.189\times10_{-8}$ gfs/mm$^2$ into the International System of Units)

rotational frequency f: 10 Hz distance $r_1$: 1.5 mm distance $r_1$: 3.0 mm mainspring: the maximum output torque of the used mainspring to be transmitted to the rotor is $0.0137\times10^{-6}$ N·m (a value obtained by converting 1.4 mgmm (a converted value at the center wheel and pinion is 8.5 gcm of the center wheel and pinion) into the International System of Units)

rotor magnet: instead of the rotor magnet, a nonmagnetic member having an equivalent shape and an equivalent weight was used in order to avoid load torque due to magnetism According to this example, since the values obtained by subtracting the calculated values from the actually measured values are substantially constant, as shown in Table 1 and the

SECOND EXAMPLE

A second example will now be described below. In this example, the relationship among the gap h set according to the formulas (5) and (6) in the first embodiment, the period of operation of the timepiece, and the thickness of the movement was examined.

The conditions in this example are as follows:

air viscosity $\mu$: 1.853 Pa·s (a value obtained by converting $0.189\times10^{-8}$ gfs/mm$^2$ into the International System of Units)

rotational frequency f: 8 Hz distance $r_1$: 1.5 mm distance $r_1$: 3.0 mm mainspring: storable energy→1.106 $\mu$J maximum output torque→6.77 N·m (a value obtained by converting 69 gcm (the maximum output torque $T_{rzmax}$ to be transmitted to the rotor is 1.4 mgmm (a converted value at the center wheel and pinion is 8.5 gcm) into the International System of Units) effective number of turns→5.72 turns output torque after the effective number of turns are unwound→2.94 N·m (a value obtained by converting 30 gcm into the Internal System of Units)

Figure 15:
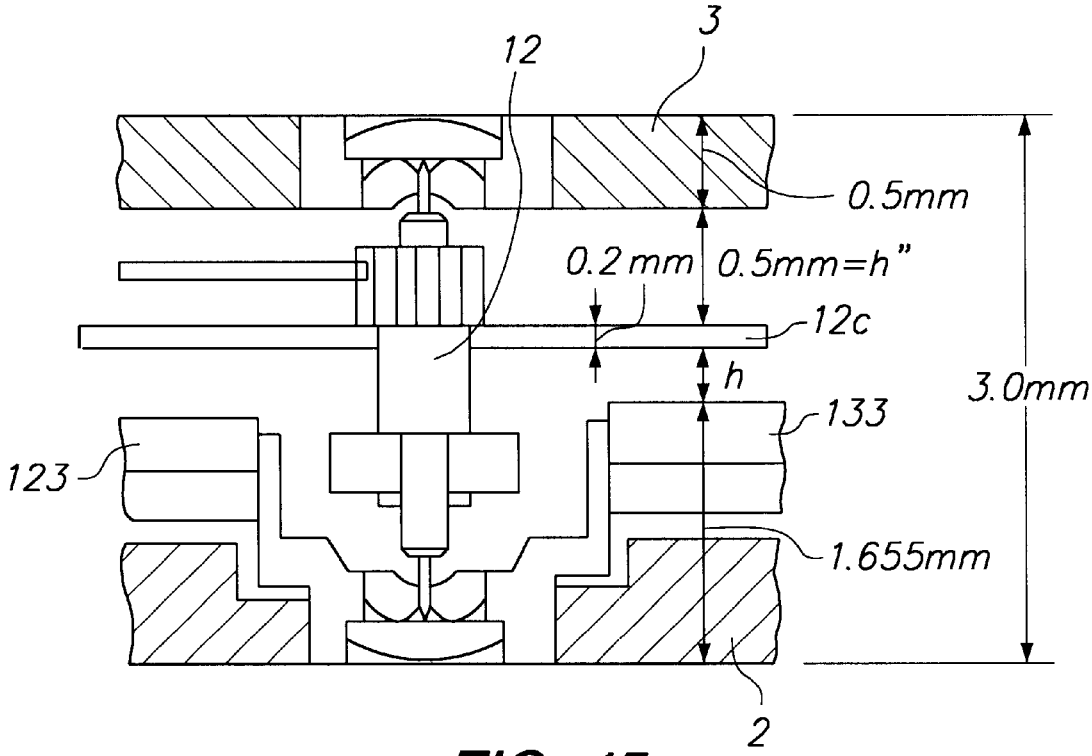
FIG. 15 is a sectional view showing a second example of the present invention.

Under the above conditions, in a case in which the speed increasing ratio from the barrel drum to the center wheel and pinion is set at 7, the gap h in an electronically controlled mechanical timepiece, which has a period of operation of 40 hours equivalent to that of the conventional mechanical timepiece, is 0.095 mm at the minimum, based on the above formulas (5) and (6). The thickness of the entire movement is 3.0 mm, as shown in FIG. 15, and the thicknesses of the components in the movement are also shown in FIG. 15. In this example, changes in period of operation and changes in thickness of the movement when the gap h was increased further were examined.

The speed increasing ratio from the barrel drum to the center wheel and pinion was appropriately selected in accordance with changes in load torque due to air viscosity resistance. Referring to FIG. 15, when the gap h≧0.55 mm, the gap h" between the train wheel bridge 3 and the rotor inertia disk 12*c* is changed so as to be equal to the gap h.

Figure 16:
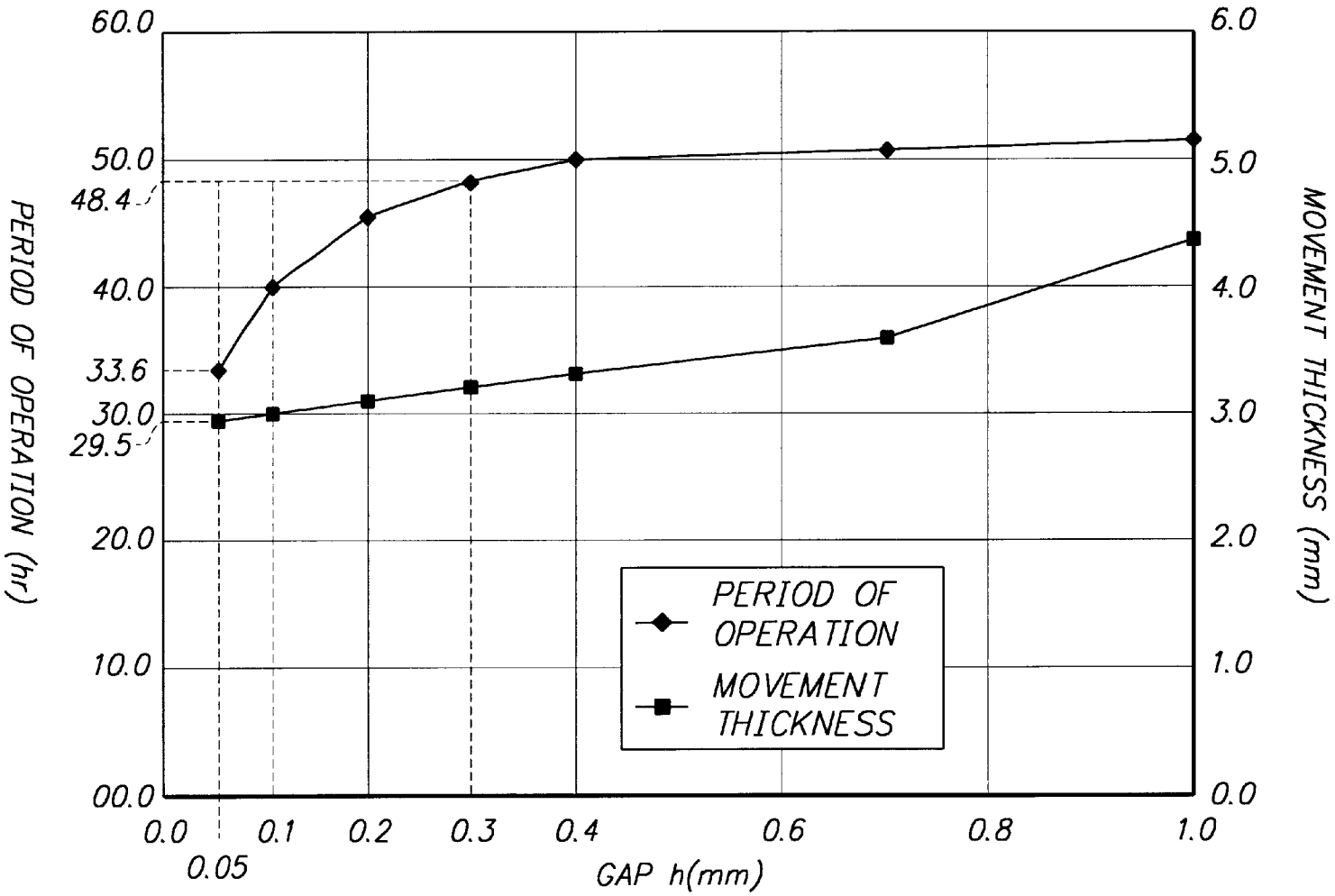
FIG. 16 is a graph showing the second example.
Figure 17:
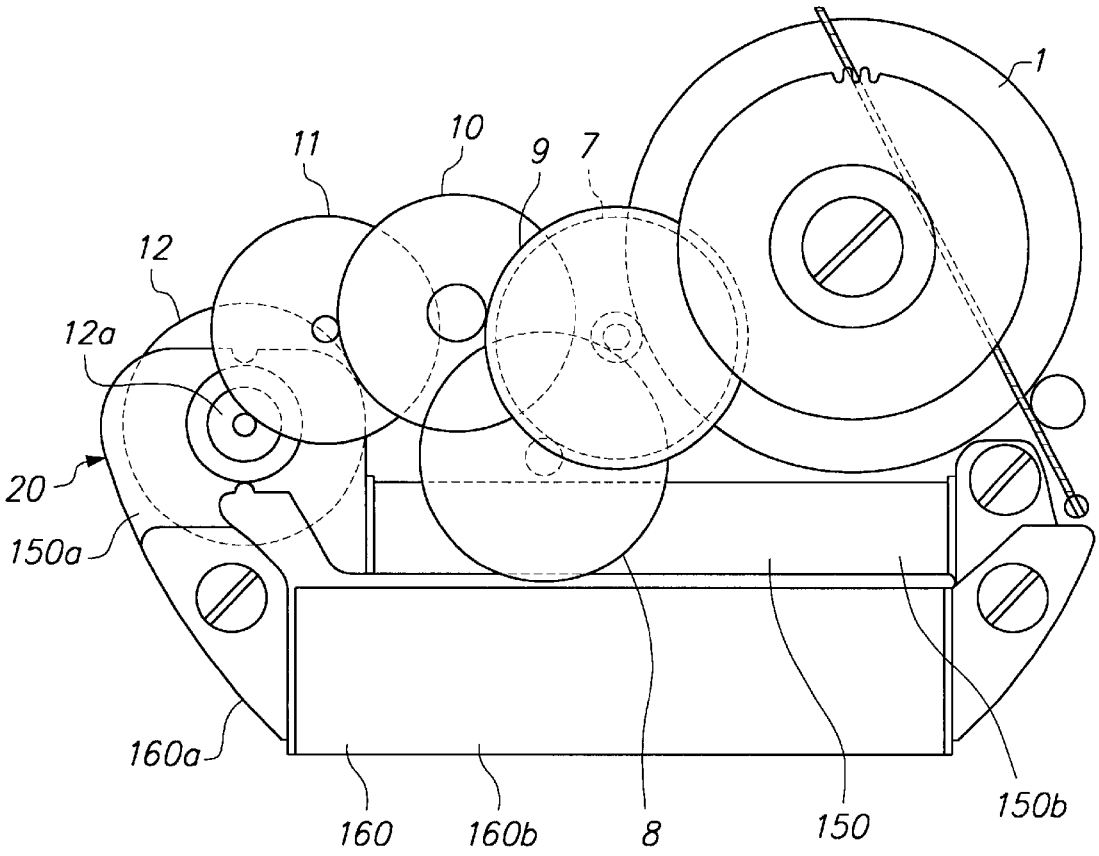
FIG. 17 is a plan view showing a conventional art.
Figure 18:
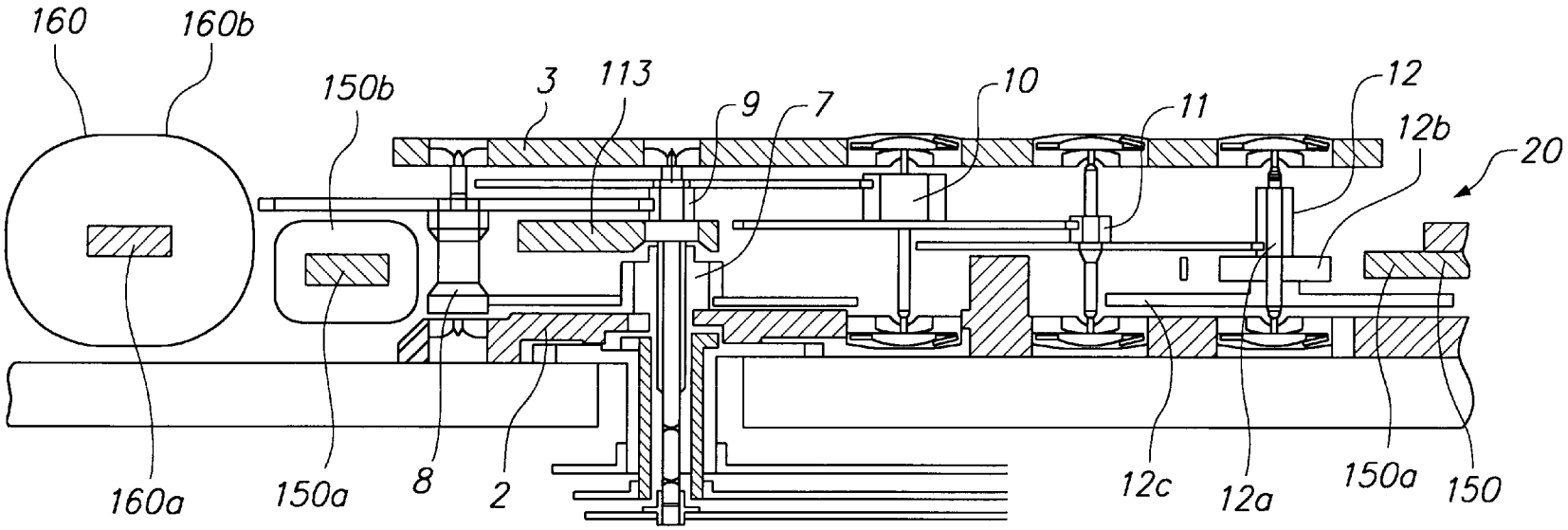
FIG. 18 is a sectional view showing the conventional art.

The results are shown in Table 2 and FIG. 16.

As shown in Table 2 and the graph shown in FIG. 16, it is confirmed that the period of operation is extended with increases in gap h, and that it is effective to set the gap h according to the above formulas (5) and (6). Since the coefficient of extension of the period of operation becomes substantially low when the gap h exceeds 0.3 mm, even if the gap h is made larger than necessary, the merit is reduced in extending the period of operation in contrast to the increase in thickness of the movement. For this reason, the period of operation can be effectively extended (48.4 hours) without making the movement very thick, by setting the gap h to be approximately 0.3 mm.

As long as the gap h is approximately 0.3 mm±0.2 mm, it can be sufficiently practical in consideration of the period of operation and the thickness of the movement.

Since the value 0.3 mm is about three times the gap h (0.095 mm) in the initial period of operation (40 hours), it is effective, based on backward calculation, to determine the gap h so as to be 1/30 (approximately 30%) of $T_{rzmax}$.

Regarding the advantages, when the period of operation is extended from 40 hours to 48 hours, for example, it is only necessary to wind the mainspring at the same time every two days in a windup electronically controlled mechanical timepiece, and time setting is unnecessary at the time of winding. Therefore, operability can be improved compared with the case in which the period of operation is 40 hours. Accordingly, the invention claimed as in Claim 2 is effective.

TABLE 2

| Gap h (mm) | Converted load torque $T_{at}$ at center wheel and pinion (gcm) | Period of operation (hr) | Movement thickness (mm) |
|---|---|---|---|
| 0.050 | 4.70 | 33.6 | 2.95 |
| 0.095 | 3.80 | 40.0 | 3.00 |
| 0.200 | 3.40 | 45.6 | 3.10 |
| 0.300 | 3.20 | 48.4 | 3.20 |
| 0.400 | 3.10 | 50.0 | 3.30 |
| 0.700 | 3.05 | 50.8 | 3.65 |
| 1.000 | 3.01 | 51.5 | 4.35 |

TABLE 2-continued

| Gap h (mm) | Converted load torque $T_{2\#}$ at center wheel and pinion (N · m) | Period of operation (hr) | Movement thickness (mm) |
|---|---|---|---|
| 0.050 | $4.6091 \times 10^{-4}$ | 33.6 | 2.95 |
| 0.095 | $3.7265 \times 10^{-4}$ | 40.0 | 3.00 |
| 0.200 | $3.3343 \times 10^{-4}$ | 45.6 | 3.10 |
| 0.300 | $3.1381 \times 10^{-4}$ | 48.4 | 3.20 |
| 0.400 | $3.0401 \times 10^{-4}$ | 50.0 | 3.30 |
| 0.700 | $2.9910 \times 10^{-4}$ | 50.8 | 3.65 |
| 1.000 | $2.9518 \times 10^{-4}$ | 51.5 | 4.35 |

INDUSTRIAL APPLICABILITY

As described above, according to the present invention, since the coefficient K and the gap h between the components are set so that the load torque due to air viscosity resistance between the components is sufficiently low, it is possible to limit the energy loss of the mainspring and to extend the period of operation of the timepiece.

What is claimed is:

1. An electronically controlled mechanical timepiece wherein mechanical energy transmitting means is driven by mechanical energy storing means serving as an energy source, electrical power is generated by a power generator rotated by said mechanical energy transmitting means, the rotation cycle of said power generator is controlled by an electronic circuit driven by the electrical power so as to brake said mechanical energy transmitting means and to thereby adjust the speed, characterized in that said power generator has a rotor rotating in connection with said mechanical energy transmitting means, and a constant K is set to be 1/10 or less when a gap h between a largest-diameter member in said rotor and a counter component fixed to most closely face said rotor in the axial direction is given by the following formula:

$$h = \frac{\pi^2 f \mu}{K T_{rz\max}} (r_2^4 - r_1^4)$$

where π represents the ratio of the circumference of a circle to its diameter, $\mu$ represents the air viscosity, f represents the rotational frequency of said rotor, $T_{rzmax}$ represents the maximum output torque of said mechanical energy storing means to be transmitted to said rotor, $r_1$ represents a distance from the center of rotation of said rotor to the inner periphery of a portion where said largest-diameter member in said rotor and said counter component overlap in a plane, and $r_2$ represents a distance from the center of rotation of said rotor to the outer periphery of the portion where said largest-diameter member in said rotor and said counter component overlap in a plane.

2. An electronically controlled mechanical timepiece according to claim 1, wherein the coefficient K is set to be 1/20 to 1/60.

3. An electronically controlled mechanical timepiece according to claim 2, wherein the coefficient K is set to be 1/20 to 1/40.

4. An electronically controlled mechanical timepiece according to claim 1, wherein said counter component is a supporting member for supporting at least one end portion of said rotor in the axial direction, and said supporting member is disposed at a greater distance in the axial direction from said rotor than a bearing held by said supporting member so as to receive the one end portion in the axial direction.

5. An electronically controlled mechanical timepiece according to claim 1, wherein said counter component is a supporting member for supporting at least one end portion of said rotor in the axial direction, said supporting member includes a holding section for holding a bearing for receiving the one end portion in the axial direction, and a portion on the periphery of said holding section is disposed at a greater distance from said rotor in the axial direction than said holding section.

6. An electronically controlled mechanical timepiece according to claim 1, wherein one end portion of said rotor in the axial direction is supported by a supporting member which is formed separately from a component for supporting said mechanical energy transmitting means and which is shaped like a bridge or is cantilevered.

7. An electronically controlled mechanical timepiece according to claim 1, wherein said mechanical energy transmitting means is a gear train including a plurality of wheels, and a gap h' in the axial direction between said rotor and said wheels serving as said mechanical energy transmitting means to be meshed with said rotor is smaller than the gap h.

8. An electronically controlled mechanical timepiece according to claim 1, wherein a proximity component is interposed between said largest-diameter member in said rotor and said counter component, and said proximity component has a through opening extending in the axial direction at a position corresponding to said largest-diameter member of said rotor.

9. An electronically controlled mechanical timepiece according to claim 1, wherein the pressure inside a movement including said mechanical energy storing means, said mechanical energy transmitting means, and said power generator, is reduced.

10. An electronically controlled mechanical timepiece according to claim 1, wherein said rotor in said power generator has an inertia wheel protruding in the radial direction, and said inertia wheel serves as said largest-diameter member in said rotor.

11. An electronically controlled mechanical timepiece according to claim 1, wherein said rotor in said power generator has a rotor member protruding in the radial direction and having a plurality of rotor magnets arranged in the circumferential direction, and said rotor member serves as said largest-diameter member in said rotor.

* * * * *